US008505240B2

(12) United States Patent
Nguyen et al.

(10) Patent No.: US 8,505,240 B2
(45) Date of Patent: Aug. 13, 2013

(54) CASEMENT AND AWNING WINDOW OPENING LIMIT DEVICE

(75) Inventors: Nghi Christopher Nguyen, Owatonna, MN (US); Derek Ronald Gramstad, Owatonna, MN (US); Scot J. Berkley, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 265 days.

(21) Appl. No.: 12/938,875

(22) Filed: Nov. 3, 2010

(65) Prior Publication Data

US 2011/0203184 A1 Aug. 25, 2011

Related U.S. Application Data

(60) Provisional application No. 61/307,705, filed on Feb. 24, 2010.

(51) Int. Cl.
*E05D 15/44* (2006.01)

(52) U.S. Cl.
USPC ..... 49/252; 49/251; 49/250; 49/246; 49/248; 49/141; 16/363; 16/364

(58) Field of Classification Search
USPC ..... 49/246–252, 141, 453, 454, 456, 49/192, 193; 16/362–364
See application file for complete search history.

(56) References Cited

U.S. PATENT DOCUMENTS

| | | | | | |
|---|---|---|---|---|---|
| 2,779,069 | A | * | 1/1957 | Ziesmer | 49/248 |
| 3,758,919 | A | * | 9/1973 | Dilworth, Jr. | 16/240 |
| 4,622,778 | A | * | 11/1986 | Simpson | 49/161 |
| RE32,846 | E | * | 1/1989 | Sandberg et al. | 16/381 |
| 4,833,754 | A | * | 5/1989 | Yang | 16/339 |
| 4,980,947 | A | * | 1/1991 | McQuigge | 16/235 |
| 5,491,930 | A | * | 2/1996 | La See | 49/252 |
| 5,568,702 | A | * | 10/1996 | Frank et al. | 49/153 |
| 5,920,959 | A | * | 7/1999 | DeMarco | 16/257 |
| 6,138,325 | A | * | 10/2000 | Figliola et al. | 16/382 |
| 7,278,185 | B2 | * | 10/2007 | Smith | 16/366 |

FOREIGN PATENT DOCUMENTS

| | | | |
|---|---|---|---|
| GB | 2262565 | | 6/1993 |
| GB | 2391901 | | 2/2004 |
| GB | 2407116 | | 4/2005 |
| GB | 2407116 | A * | 4/2005 |

OTHER PUBLICATIONS

Minnesota Rules Part 1303.2300 to 1303.2330 and 1305.1405 Window Fall Prevention Provisions, Circa 2009, 1 Pg.

(Continued)

*Primary Examiner* — Katherine Mitchell
*Assistant Examiner* — Marcus Menezes
(74) *Attorney, Agent, or Firm* — Patterson Thuente Pedersen, P.A.

(57) ABSTRACT

A device to limit an opening of a window having a hinged sash coupled to a window frame including a window opening limiting structure having a first member and a second member. One of them is securable to the sash and the other of the first member and the second member being securable to the frame. A selectively releasable coupler by which the first member and the second member are couplable is shiftable between a coupled status and a released status. The first member and the second member bridge a preselected distance such that the sash is inhibited from opening beyond a predetermined distance. The coupler is releasable so that the sash can be opened beyond the predetermined distance and re-engages automatically when the sash is closed.

16 Claims, 29 Drawing Sheets

(56) References Cited

OTHER PUBLICATIONS

Copyright by ASTM Int'l, Jun. 2009, "Standard Specification for Window Fall Prevention Devices With Emergency Escape (Egress) Release Mechanisms", 11 Pgs.

CTC Area of Study—Child Window Safety, 2007/2008 Code Changes, Circa 2007, 4 Pgs.

"CTC Window Safety Study Group 2009/2010 Cycle Proposals" Dated Mar. 27, 2009, 3 Pgs.

Canadian Office Action cited in Canadian Application No. 2,757,154, dated May 3, 2012, 4 Pgs.

* cited by examiner

CASEMENT AND AWNING WINDOW OPENING LIMIT DEVICE

RELATED APPLICATION

This application claims the benefit of U.S. Provisional Application No. 61/307,705 filed Feb. 24, 2010, which is incorporated herein in its entirety by reference.

FIELD OF THE INVENTION

The present invention relates to casement and awning windows and, more specifically, to devices for limiting the opening of casement and awning windows.

BACKGROUND OF THE INVENTION

A casement or an awning window generally refers to a sash that is attached to its frame by one or more hinges. The hinges can be located on any side of the sash and the frame though generally not on the lower edge of the sash and frame. In general, a casement window rotates along a horizontal plane (the hinges of a casement window defining a vertical rotation axis), while an awning window rotates along a vertical plane (the hinges of an awning window defining a horizontal rotation axis). Most casement and awning windows which employ the use of a crank lever or cam handle operator open outwardly so as not to interfere with the operator of the window.

An advantage of many casement and awning windows is that substantially the full window opening can be exposed without requiring the removal of the window from the frame. In contrast, for example only half of the opening of a double-hung window can be exposed by raising the lower sash or lowering the upper sash. The sashes of double hung or horizontally sliding windows must be completely removed from the frame to expose the entire window opening.

The ability of casement windows to be opened so as to fully expose the window opening also can be disadvantageous, however. In certain instances, some casement and awning windows can be opened wide enough that individuals or large objects can fit through the opening.

Recent modifications to building codes and window safety standards have been implemented in an effort to prevent or deter injuries to individuals, particularly children, from falling out of open windows. For example, proposed changes to the International Building Code ("IBC") and the International Residential Code ("IRC") aimed at child window safety require that certain windows be fitted with window opening control devices. Such window opening control devices may limit the ability of casement windows to be opened beyond a certain point. This limited opening is typically defined by the maximum diameter of a hypothetical sphere that is allowed to pass through the window opening when the sash of the window is opened to the limited position. For example, current CTC safety standards stipulate that a 4-inch diameter sphere shall not pass the opening of a casement or awning window when the opening is in its largest opened position.

At times, there may be a need to override the window opening limit device so that the casement window can be opened beyond the limited position. In particular, it may be necessary to fully open the window. During an emergency, for example, an egress casement window opening may provide an escape route for individuals or an access route for emergency personnel. Accordingly, building and residential codes may require window opening limit devices to be equipped with a release mechanism. The need may also exist that such window opening limit devices be operable without keys, tools, or special knowledge and deter or prevent operation by young children.

Unless the window opening limit device is reengaged once released, casement windows could potentially be operated so as to allow the window opening to be fully exposed. Subsequent users, for example, may not realize that the window is equipped with such a device or that the device has been released. Therefore, there exists a need for window opening limit devices to possess the capability to be self re-engaging even if a user does not intend to reengage the device through the user's actions.

The cost of replacing windows is often significant. Therefore, there also exists a need for a window opening limit device that can be installed onto existing casement windows.

In addition, existing casement and awning windows are not uniform in size. In fact, the size of casement and awning windows can vary substantially. Therefore, there exists a further need for a window opening limit device that can be installed onto existing casement or awning windows regardless of the dimensions of the window frame.

SUMMARY OF THE INVENTION

The present invention substantially addresses the aforementioned needs of the industry. Throughout this application structures may referred to as being associated with a window sash or frame for convenience of description. It is to be understood that the embodiments of the invention described herein can generally be reversed so that the sash component can be attached to the frame and/or the frame component can be secured to the sash. Accordingly, the fact that this specification refers to a sash component or a frame component should not be considered limiting to the inventions disclosed herein.

According to one embodiment of the invention, a window opening limiting device includes a sash bracket, a limiting arm, and a track with a release mechanism. The sash bracket may be coupled to a side of the casement window sash and the track may be coupled to a corresponding side of the casement window frame. The arrangement may be reversed as well. The sash bracket is generally coupled to the side of the window sash opposite the side of the sash that is hinged to the window frame. The limiting arm is coupled to the sash bracket and the track. The length of the limiting arm controls how far the sash can be opened from the closed position before reaching the limited position. The end of the limiting arm that is distal from the bracket includes a pin or wheel that engages in the track and which when the window is opened travels from a first end of the track to a second end of the track.

At the second end of the track is located the release mechanism. When the pin or wheel abuts the release mechanism, opening of the sash is limited by the abutment. When is it desired to open the sash further than the limited opening permitted, the release mechanism is activated thus permitting the pin or wheel to exit the second end of the track and the sash to open completely. In an embodiment, the release mechanism requires two independent actions to effect release: a sliding motion of one element and a pivoting motion of another element. The limiting arm is biased, for example by a spring, to a desired position so that when the window is closed the pin or wheel is forced against the bias of the spring to the first end of the track where the pin or wheel reenters the first end of the track and is thus placed in a position to limit the opening of the window without further action of the individual operating the window. The window opening limiting device is thus self-resetting upon closing the window.

Another embodiment of the invention includes a sash arm coupled to the sash by a sash bracket and a frame arm coupled to the frame by a frame bracket. The sash arm is biased to a desired position by a positioning spring or other biasing structure. The sash arm further includes a slider lock and a receiving hook. The frame arm also includes a positioning spring or other biasing member to bias the frame arm to a desired position. The frame arm also includes a pin at its distal end that is sized and configured to engage the receiving hook of the sash arm. The pin is pivotable within the receiver hook so that the sash arm and the frame arm may pivot relative to each other as well as relative to their respective sash bracket and frame bracket. When the casement sash has reached the window opening limited position, the sash arm engaged to the frame arm at the pin and receiver hook reach the limit of their length having pivoted relative to each other and stop further opening movement of the sash.

The slider lock may be slid back by an individual operating the sash to release the pin from the receiver hook so that the casement sash may be opened to its fully open position. The biasing springs hold the sash arm and frame arm in position so that as the sash is closed the pin engages the receiver hook and presses back the slider lock which is biased toward the distal end of the sash arm and permits the pin to reengage with the receiver hook, thus reactivating the opening limited device for the next opening of the window.

In another embodiment of the invention, the window opening limiting device includes a sash arm assembly and a track assembly. The sash arm assembly includes a hinged mounting bracket, a pivotable arm and a pin at a distal end of the pivotable arm. The slider assembly includes a track with a slider. The slider includes a toggle latch that is biased toward an open position and a release button that secures the toggle latch in the closed position when the toggle latch is closed. The release button also can be pressed to release the toggle latch from the closed position so that the spring bias can direct it toward the open position. When the window is open, the pivotable arm pivots relative to the hinged mounting bracket and the pin which is engaged in the toggle latch causes the slider to slide along the track. When the pivotable arm reaches its most direct extension and the slider reaches the second end of the track, the window opening is limited.

When it is desired to open the window to a further extent, an individual operating the window can press the release button and release the toggle latch which then allows the pin at the distal end of the pivotable arm to be separated from the toggle latch. The window then can be opened to its full extent. The pivotable arm is spring biased or otherwise biased to a desired position so that when the window is closed, the pin at the distal end of the pivotable arm engages the toggle latch and overcomes the bias of the toggle latch to cause the toggle latch to assume a closed position at which the toggle latch is secured close by the release button. The slider is then pushed along the track to the first end of the track as the window is closed, thus, the window opening limiting device is reset to limit the opening of the window upon the next opening of the window. This and other embodiments of the invention may also include a hinge in the mounting bracket of the sash arm assembly which permits the pivotable arm to pivot along an axis 90° to its first pivoting axis about which the arm pivots.

In another exemplary embodiment of the invention, the window opening limiting device includes a frame bracket supporting a fixed pin, and a biased sash arm that is biased toward the window frame and frame bracket. The sash arm includes a slide hook assembly at a distal end thereof. The slide hook assembly includes a moveable slide including a hook near the end and a ramp structure at the end of the sash arm.

In this embodiment, when the casement sash is opened, the bias of the sash arm biases it toward the frame bracket with pin. As the sash arm slides along the pin, the pin eventually reaches the slide hook assembly at the end of the sash arm. The hook assembly engages the pin on the frame bracket and prevents further opening movement of the casement window sash. When it is desire to open the casement window sash to a larger degree, the individual operating the sash grasps the slide of the slide hook assembly and can slide it distally against spring tension or other biasing force to release the pin from the slide hook assembly. It is then possible to open the casement window sash further and to its full opening capacity. When the casement window sash is closed, the sash arm, which is biased toward the sash frame, contacts the sash frame at its distal end and slides against the sash frame until the distal end which has a ramp shaped structure thereon contacts the fixed pin of the frame bracket. The ramp structure then rides up over the fixed pin so that the fixed pin passes proximally beyond the slide hook assembly relative to the sash arm. The sash arm then can lie against the pin and rest in this position, reset, awaiting the next opening of the window.

Another embodiment of the invention includes a sash arm biased toward the frame and a slide track receiver on the frame. A keeper on the slide track receiver is slidably or pivotally coupled to the receiver and when in a closed position forms a close ended slide track within the slide track receiver. The biased sash arm includes a pin at its distal end that can be received in the slide track. As the window is opened, the pin at the end of the biased sash arm travels within the slide track until it reaches and abuts the keeper at the end of the slide track and thus stops the window from opening farther. When it is desired to open the window further, an individual operating the window can press a push tab on the keeper to either slide or pivot the keeper to open it and to release the pin at the end of the biased sash arm from the slide track. It is then possible to open the window to its fully opening capacity.

The spring bias of the sash arm keeps it in a position extended outwardly toward the frame so that as the window is closed the pin contacts the slide track receiver assembly and working against the closing bias of the keeper either slides or pivots the keeper to permit the pin to enter the slide track. The pin then travels down the slide track as the sash arm is pivoted toward the sash until the window is in a closed position. Thus, the window opening limiting device is prepared for another operation when next the window opens.

Another embodiment of the invention includes dual sash arms that share a common pivot on a frame bracket. The dual sash arms include a catch thereon that engages when the two sash arms approach each other on the common pivot and prevents the dual sash arms from moving beyond a certain point. The distal ends of the sash arms engage each into an individual dual track via pins on the distal ends thereof.

The tracks are arranged so that the dual arms travel in opposite directions as the window is open and closed. As the casement window sash is open, the pins of the distal ends of the dual sash arms move toward each other and the sash arms themselves move toward each other until a catch at a juncture of the two sash arms stops further movement of the sash arms while the pins at the distal ends of the sash arms are still engaged in the tracks. This stops the window from opening beyond its opening limited position.

When it is desired to open the window further beyond the opening limited position, an individual operating the window releases the catch that prevents further movement of the dual sash arms relative to each other, the two sash arms are then permitted to pass each other and the catch engages again but this time holding the two sash arms in an extended position biased toward the window frame and so that he distal pins are close enough together to pass through the gap between the dual tracks. The window can then be opened to its full capacity. As the window is again closed, the pins at the end of the duals sash arms are each received through the gap between the two tracks and into their respective track and begin to be forced away from each other by movement of the casement window sash. The force applied to the dual sash arms overcomes the releasable catch at the Y juncture of the sash arms and the sash arms gradually are spread and moved toward the frame until the window is closed. Because the pins at the end of the sash arms have reentered the dual tracks and the catch at the juncture of the sash arms has been reset by the closing of the window. The window opening limiting device is now prepared for the next operation.

Another embodiment of the invention also includes dual sash arms and tracks. The two sash arms are forced toward each other as the window opens and eventually reach a point where they are fully extended outwardly and because they are still engaged in the dual sash tracks prevent the window from opening further. When it is desired to open the window beyond the opening limited position, an individual operating the window can grasp the dual sash arms and squeeze them together to overcome a bias thus removing them from between the dual tracks. It is then possible to open the window to its full capacity.

The entrance to the space between the dual tracks has a ramped slope so as the window closes the ramps engage the pins on the two sides of the access opening to the dual tracks. The ramped tracks then overcome the bias of the dual sash arms and direct the pins inwardly until the dual sash arm pins are within the dual tracks. At this point, the pins abut the back wall of the dual tracks and as the window continues to close the dual sash arms are forced apart and slide along the dual tracks until the dual sash arms are generally parallel to the sash. Thus, this embodiment of the invention is prepared again to limit the opening of the casement sash at the next operation.

Another embodiment of the invention includes a U-shaped sash arm defining a longitudinal slot therein. The U-shaped sash arm is secured to a sash bracket and includes a pivoting catch at the distal end thereof that closes off the longitudinal slot when in a closed orientation. This embodiment also includes a fixed pin on a bracket secured to one of the sash or the frame. The catch at the end of the longitudinal slot is structured so that when the fixed pin is received in the longitudinal slot the catch prevents the fixed pin from departing from the distal open end of the longitudinal slot. The catch is further arranged so that it can be released and so that when the fixed pin enters the longitudinal slot it resets the catch in the latched orientation.

In this embodiment of the invention, when the casement sash is opened the fixed pin travels along the longitudinal slot from proximal to distal until it abuts the catch at the distal end the slot. At this point, the abutment of the fixed pin with the catch at the distal end of the slot prevents the casement sash from opening beyond the window opening limited position.

When it is desired to open the window beyond its window opening limited position, an individual operating the window releases a lever or other actuator to release the catch at the distal end of the longitudinal slot. The pin is thus enabled to exit the longitudinal slot and enables that casement sash to be opened to its full extent. The bracket at the proximal end of the U-shaped arm includes a biasing member, such as a spring, to hold the U-shaped arm in a desired position so that when the window sash is closed the pin enters the distal end of the longitudinal slot and overcomes the bias of the catch to transition the catch from the open position to a closed position. As the casement sash continues to close the pin travels down the longitudinal slot toward the proximal end of the U-shaped arm. When the U-shaped arm is generally parallel to the window frame and sash and the window is closed the window opening limiting device of this embodiment is then prepared to stop the window at the limiting position when the window is next opened.

The window opening limit devices can be installed on existing casement windows of different dimensions to uniformly limit the maximum open position of the window. The limiting arm can be actively released by a user so that the sash can be opened from a closed position to a fully opened position. The limiting devices are adapted to passively reengage when the window is closed so that the sash can only be opened from the closed position to the limited position.

BRIEF DESCRIPTION OF THE DRAWINGS

The invention may be more completely understood in consideration of the following detailed description of various embodiments of the invention in connection with the following drawings, in which.

Figure 1:
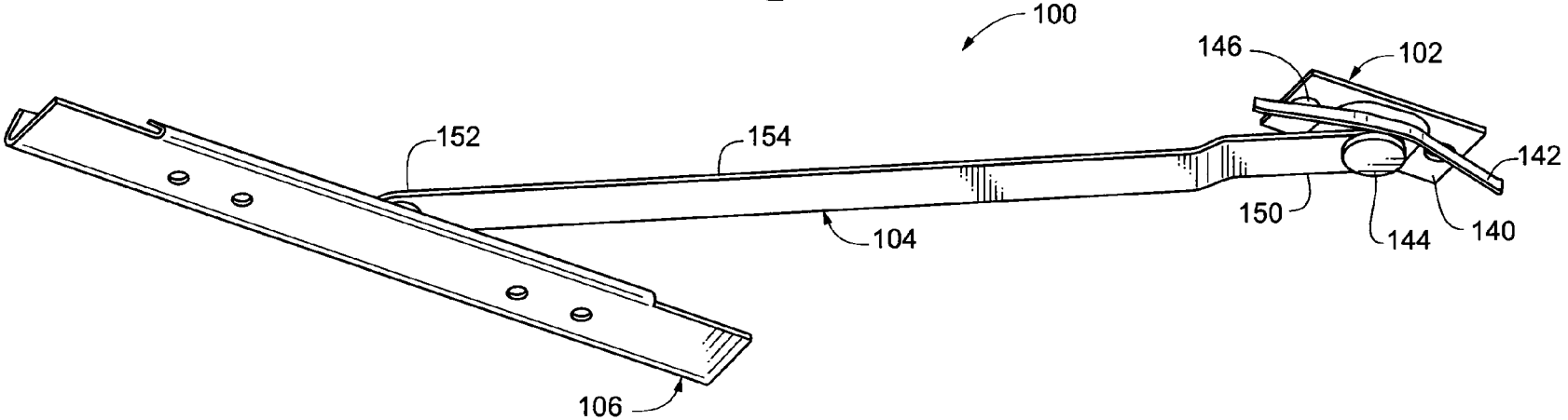
FIG. 1 is a perspective view of a window opening limit device according to an example embodiment of the invention with some parts removed for clarity.

While the present invention is amenable to various modification and alternative forms, specifics thereof have been shown by way of example in the drawings and will be described in detail. It should be understood however, that the intention is not to limit the invention to the particular embodiments described. On the contrary, the intention is to cover all modifications, equivalents, and alternatives falling within the spirit and scope of the invention. In particular, although the invention is primarily described in the context of a casement window, the invention is equally applicable in the context of an awning window.

DETAILED DESCRIPTION

An exemplary embodiment of window opening limit device 100 in accordance with the invention is depicted in FIGS. 1-2 and 4-6. Window opening limiting device 100 generally includes sash bracket 102, limiting arm 104, and track 106.

Figure 3:
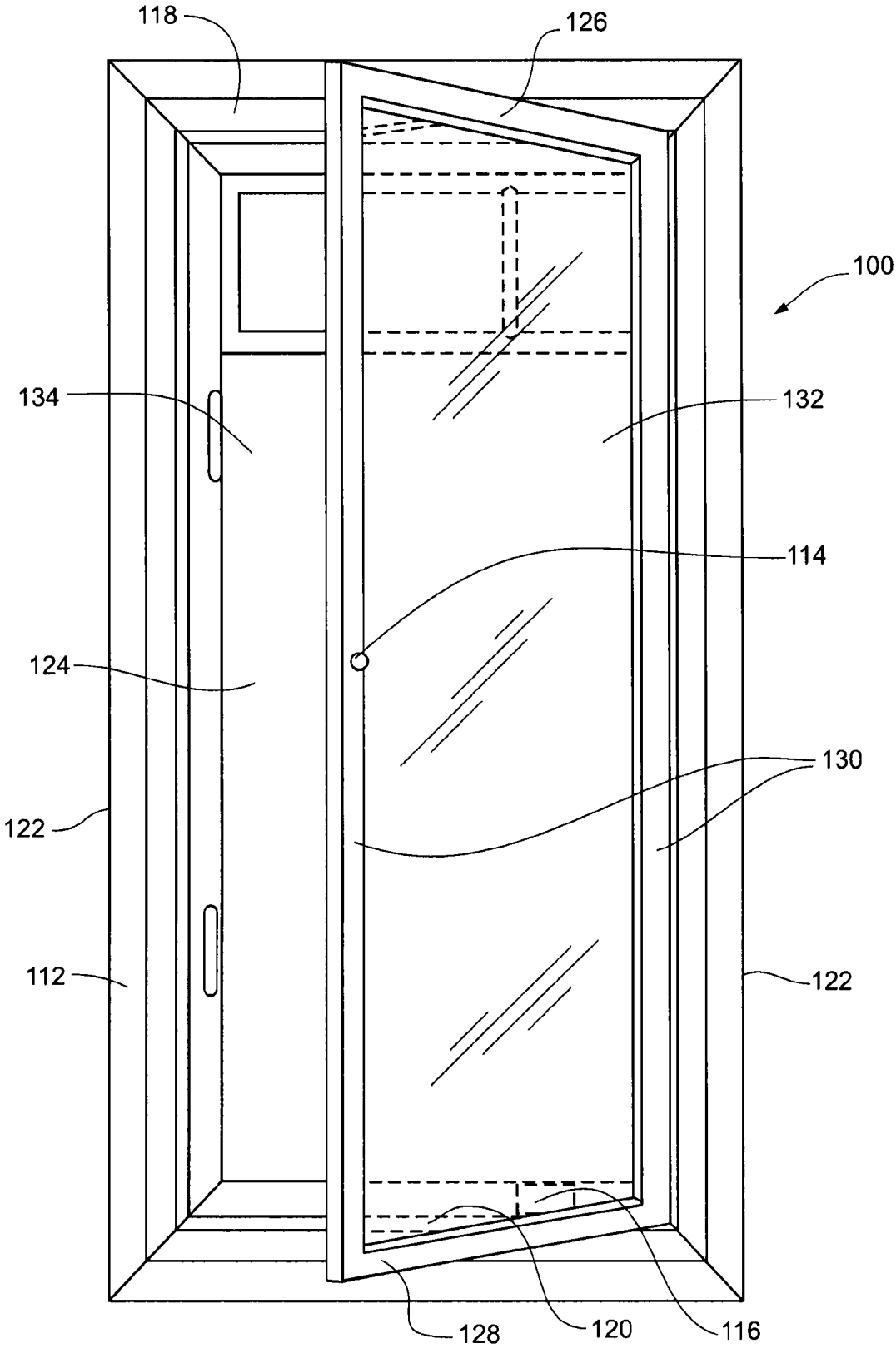
FIG. 3 is a perspective view of a casement window.
Figure 4:
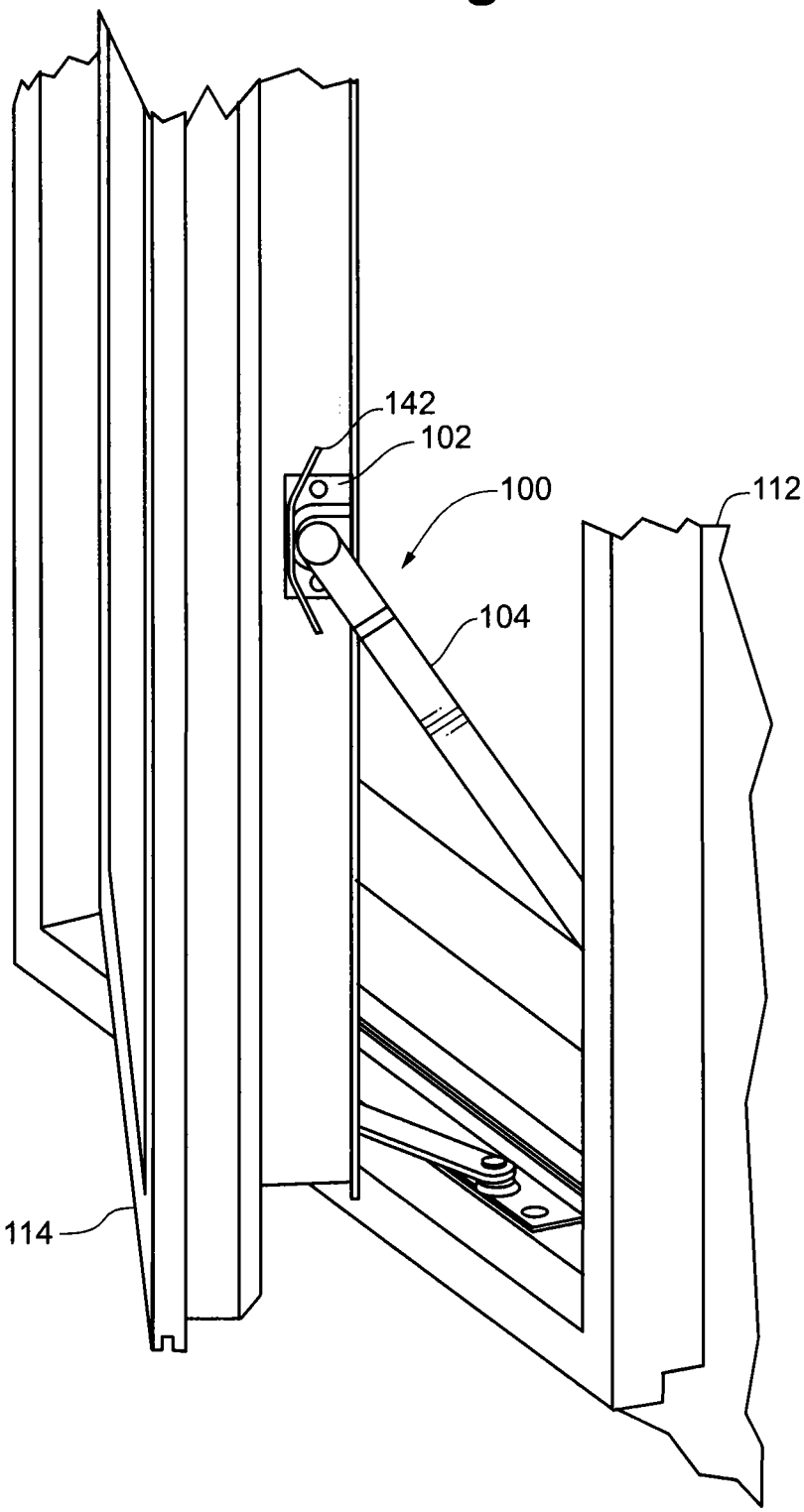
FIG. 4 is a perspective view of a window opening limit device of FIGS. 1 and 2 installed in a window.
Figure 5:
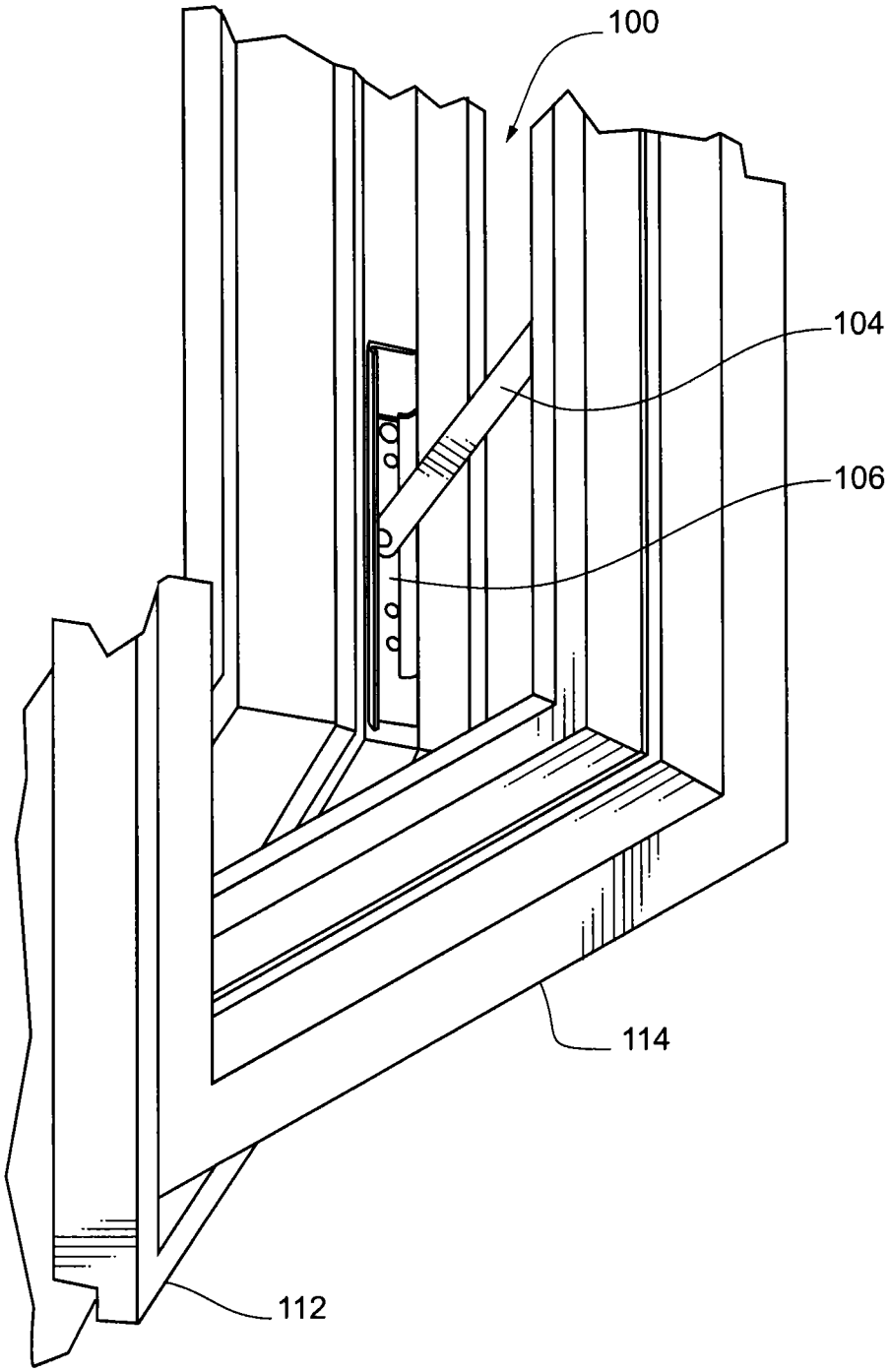
FIG. 5 is another perspective view of a window opening limit device of FIG. 4 installed in a window.
Figure 6:
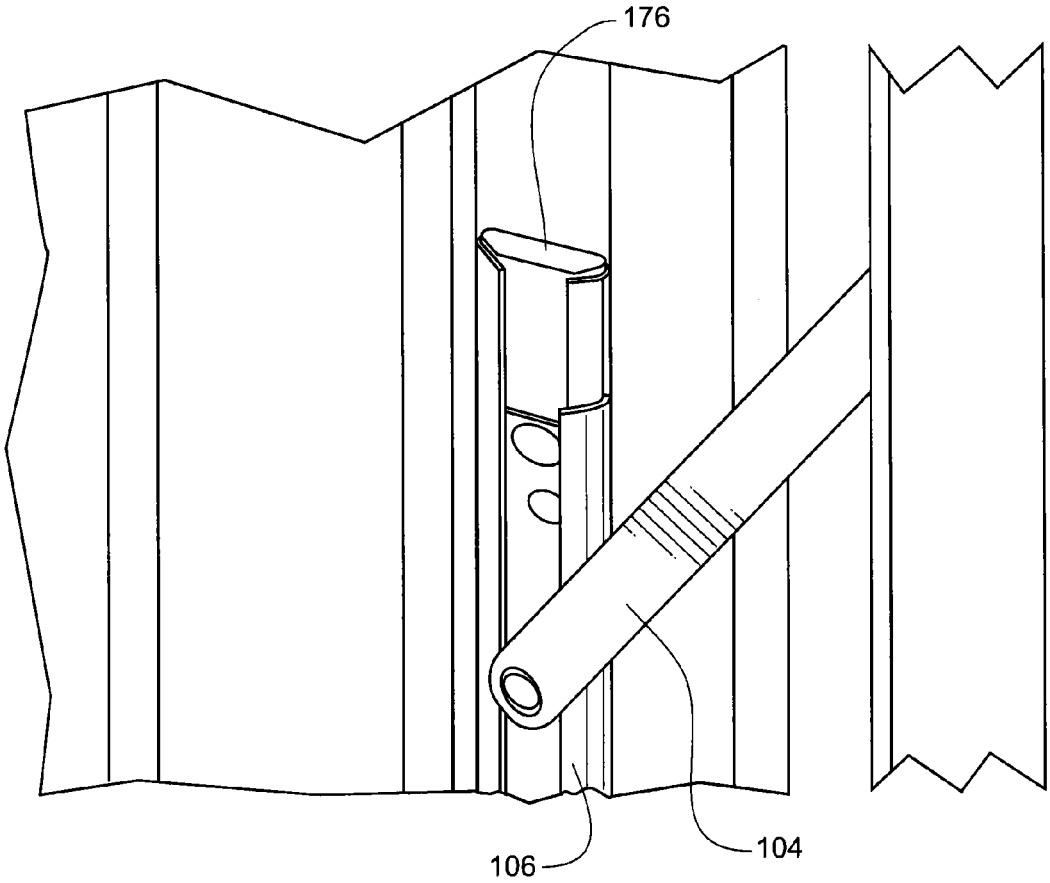
FIG. 6 is a detailed perspective view of a track and a limiting arm of a window opening limit device according to an embodiment of the present invention, when the sash is positioned in the opening limited position.

For reference purposes, an example of casement window 110 is depicted in FIG. 3. Casement window 110 generally includes frame 112, sash 114, and operator mechanism 116. Frame 112 includes head jamb 118, sill 120, and sides 122 and defines window opening 124. Sash 114 includes top rail 126, bottom 128, side rails 130, and window pane 132. Sash 114 may also include screen 134. Sash 114 is typically coupled with hinges (not shown) to frame 112 and can be opened and closed through operation of operator mechanism 116.

Referring to FIGS. 1-2 and 4-16, sash bracket 102 generally includes mounting bracket 140, biasing member 142, and stabilizer head 144. Sash bracket 102 may also define mounting apertures 146. Generally, sash bracket 102 is structured to have a low-profile such that pivot head 144 does not extend beyond the outermost edge of side rail 130.

Figure 2:
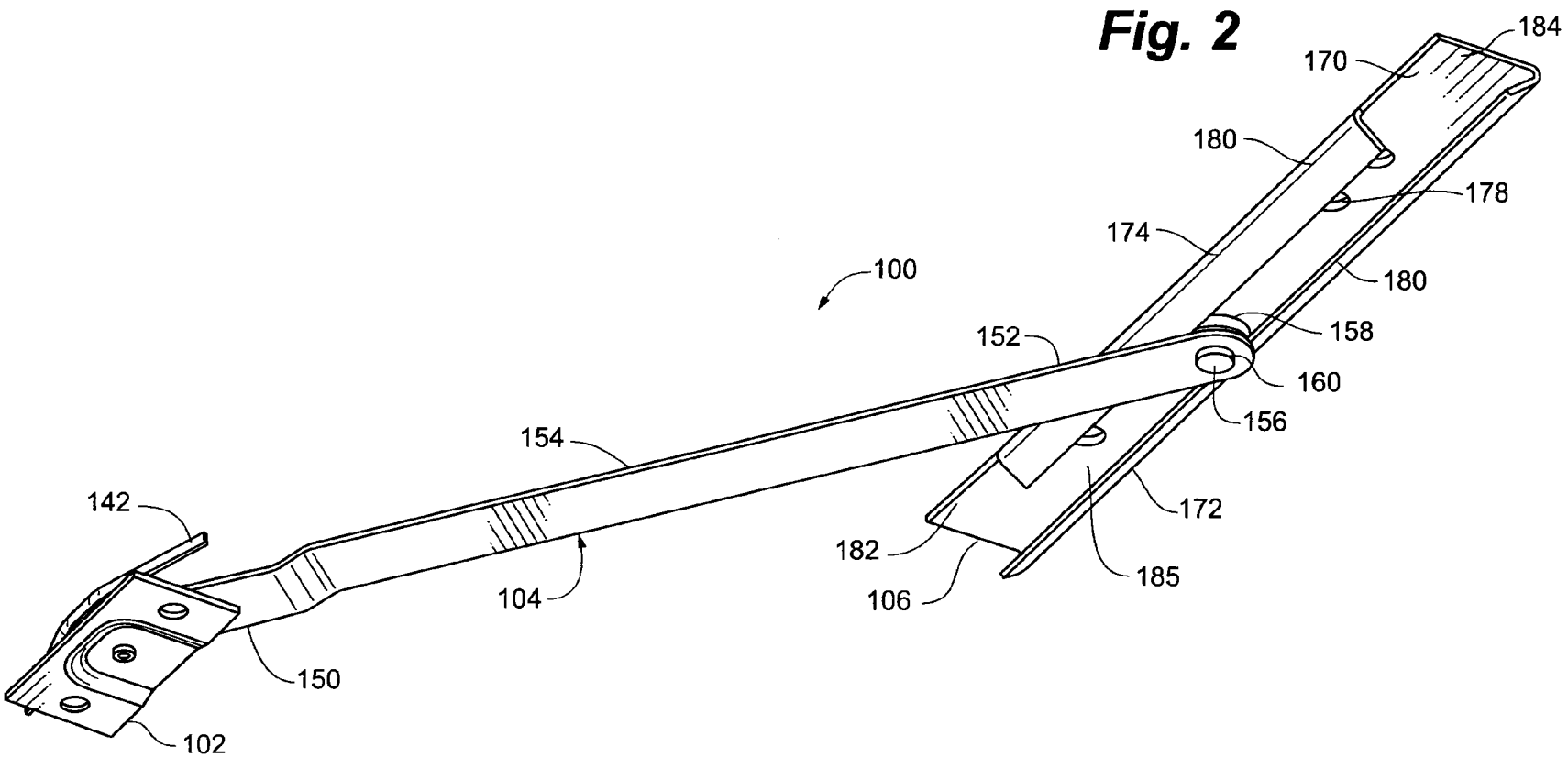
FIG. 2 is a perspective view of the window opening limit device of FIG. 1 from an opposing direction.

Limiting arm 104 presents proximal end 150, distal end 152, and main section 154 extending between distal and proximal ends 150, 152. Proximal end 150 is pivotably coupled to sash bracket 102. Distal end 152 may be slightly offset from main section 154, as depicted in FIGS. 1-2. Distal end 152 generally includes engagement structure 156 adapted to releasably engage track 106. In an example embodiment, engagement structure 156 may be slide wheel 158 that is rotatable on axle 160.

Track 106 generally includes main plate 170, primary flange 172, and secondary flange 174. Track 106 may also include stop 176. A biasing member (not shown) may be positioned intermediate main plate 170 and stop 176. Main plate 170 defines apertures 178 adapted to receive fastening members (not shown) for coupling track 106 to frame 112. In an embodiment, track 106 is adapted for mounting on the inside surface of sides 122. Primary and secondary flanges 170, 172 may have beveled edges 178 and lips 180 to retain and guide slide wheel 158 proximal main plate 170. Primary flange 172 generally extends the length of main plate 170. Secondary flange 174 generally extends for only a portion of the length of main plate 170. Primary flange 172 and secondary flange 174 thereby define engagement region 182 and disengagement region 184 on main plate 170. In an embodiment, stop 176 is positioned in or proximal to disengagement region 184. Main plate 170, primary flange 172, secondary flange 174 define channel 185 adapted to receive slide wheel 158.

Figure 7:
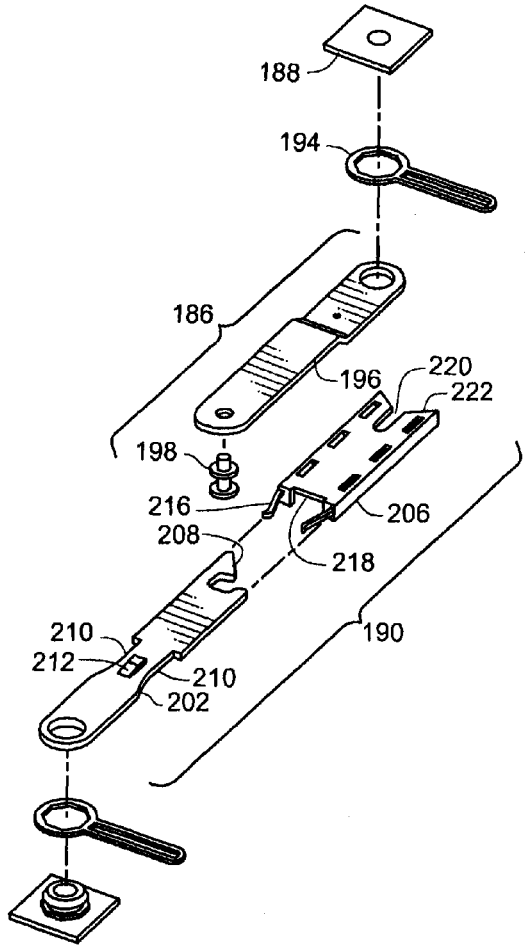
FIG. 7 is an exploded perspective view and a side view of a window opening limit device according to an embodiment of the present invention.
Figure 8:
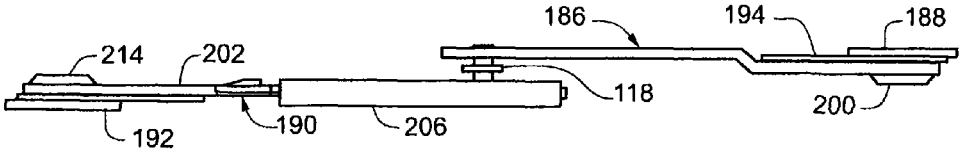
FIG. 8 is an elevational view of the window opening limit device
Figure 9:
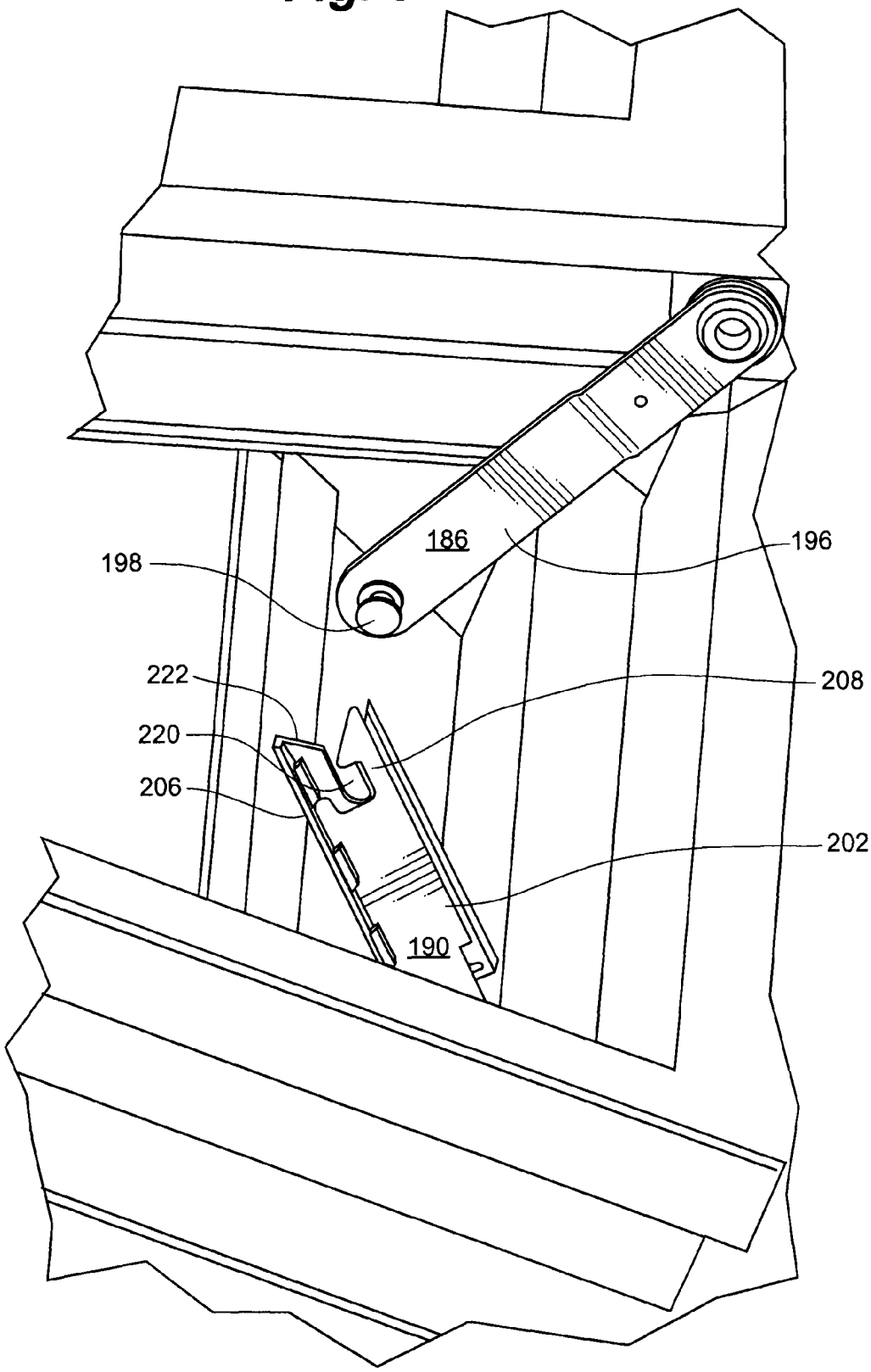
FIG. 9 is a perspective view of the window opening limit device of FIG. 7 installed in a window in an uncoupled state.

Another embodiment of window opening limiting device 100 is depicted in FIGS. 7-10. Referring particularly to FIGS. 7 and 8, sash arm 186 generally includes position biasing member 194, arm 196 and coupling pin 198. Sash arm 186 is coupled to sash bracket 188 at pivot axle 200. Position biasing member 194 is located between sash arm 186 and sash bracket 188. Position biasing member 194, biases sash arm 186 to a desired position. Coupling pin 198 is secured to a distal end of arm 196 relative to sash bracket 188.

Frame arm 190 generally includes arm 202, position biasing member 204 and slider lock 206. In this example embodiment, arm 202 presents receiving hook 208 at a distal end thereof, spring indentations 210 and slider lock stop 212. Arm 202 is coupled to frame bracket 192 by pivot axle 214.

Figure 10:
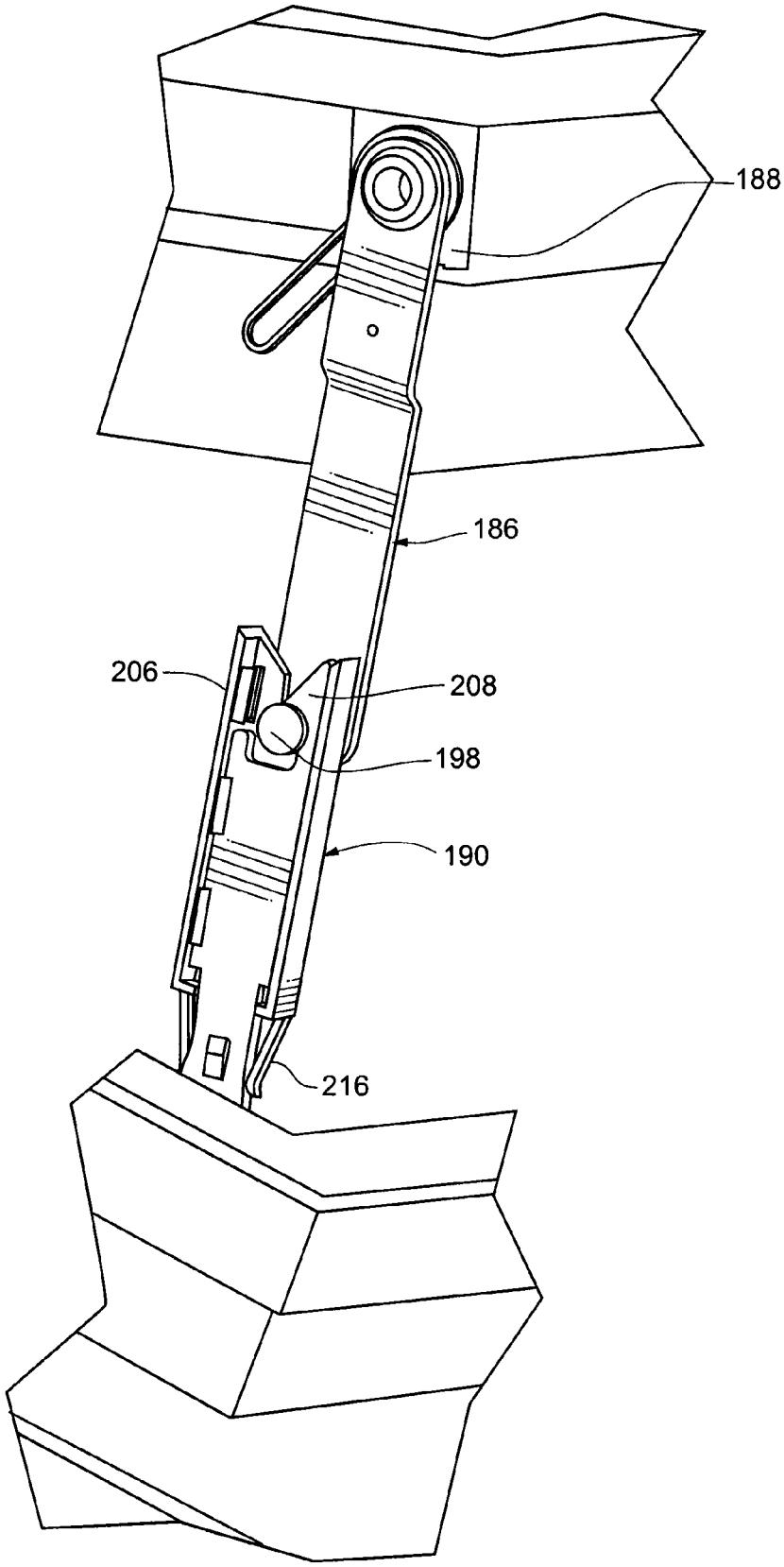
FIG. 10 is a perspective view of the window opening limit device of FIG. 7 installed in a window in a coupled state.

In this example embodiment, slider lock 206 is configured to slide over arm 202. Slider lock 206 presents spring members 216, slider channel 218, coupling pin receiving slot 220 and tapered entrance 222. When moved distally relative to arm 202, slider lock 206 abuts slider lock stop 212. Receiving hook 208 is configured to accept coupling pin 198 therein. Coupling pin receiving slot 220 is sized to receive coupling pin 198 therein and to slidably secure coupling pin within receiving hook 208 when slider lock 206 is advanced toward an over receiving hook 208. Position biasing member 204 is operably coupled to frame bracket 192 and arm 202 and positioned to bias frame arm 190 to a desired position. Window opening limiting device 100, according to this embodiment of the invention, is depicted in an uncoupled state in FIG. 9 wherein coupling pin 198 is not received in receiving hook 208. FIG. 10 depicts window opening limiting device 100 according to this embodiment of the invention in a coupled state wherein coupling pin 198 is received in receiving hook 208 and secured therein by slider lock stop 212.

Figure 11:
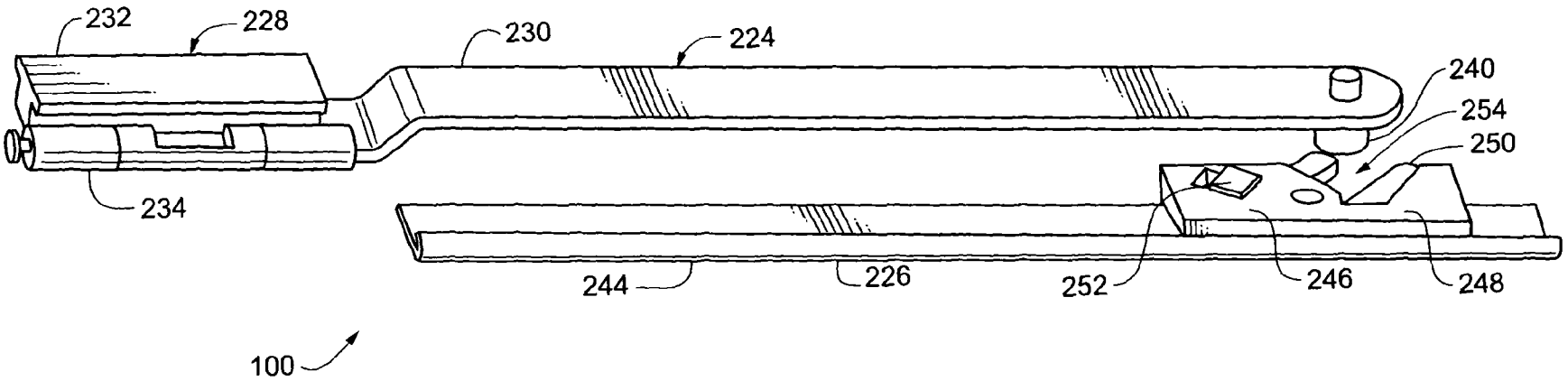
FIG. 11 is a perspective view of a window opening limit device according to another embodiment of the present invention in an uncoupled state.
Figure 12:
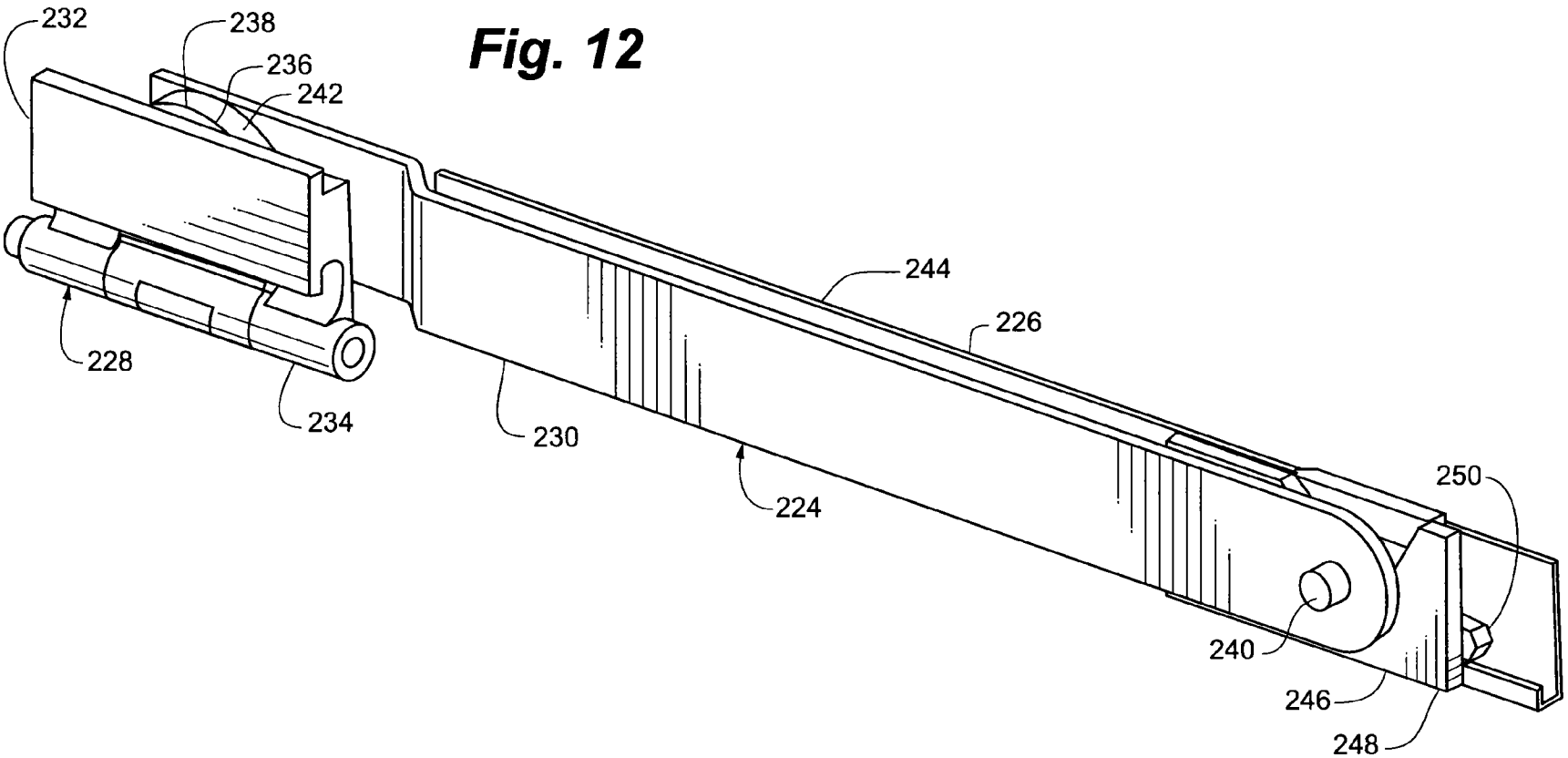
FIG. 12 is a perspective view of a window opening limit device of FIG. 11 in a coupled state.
Figure 13:
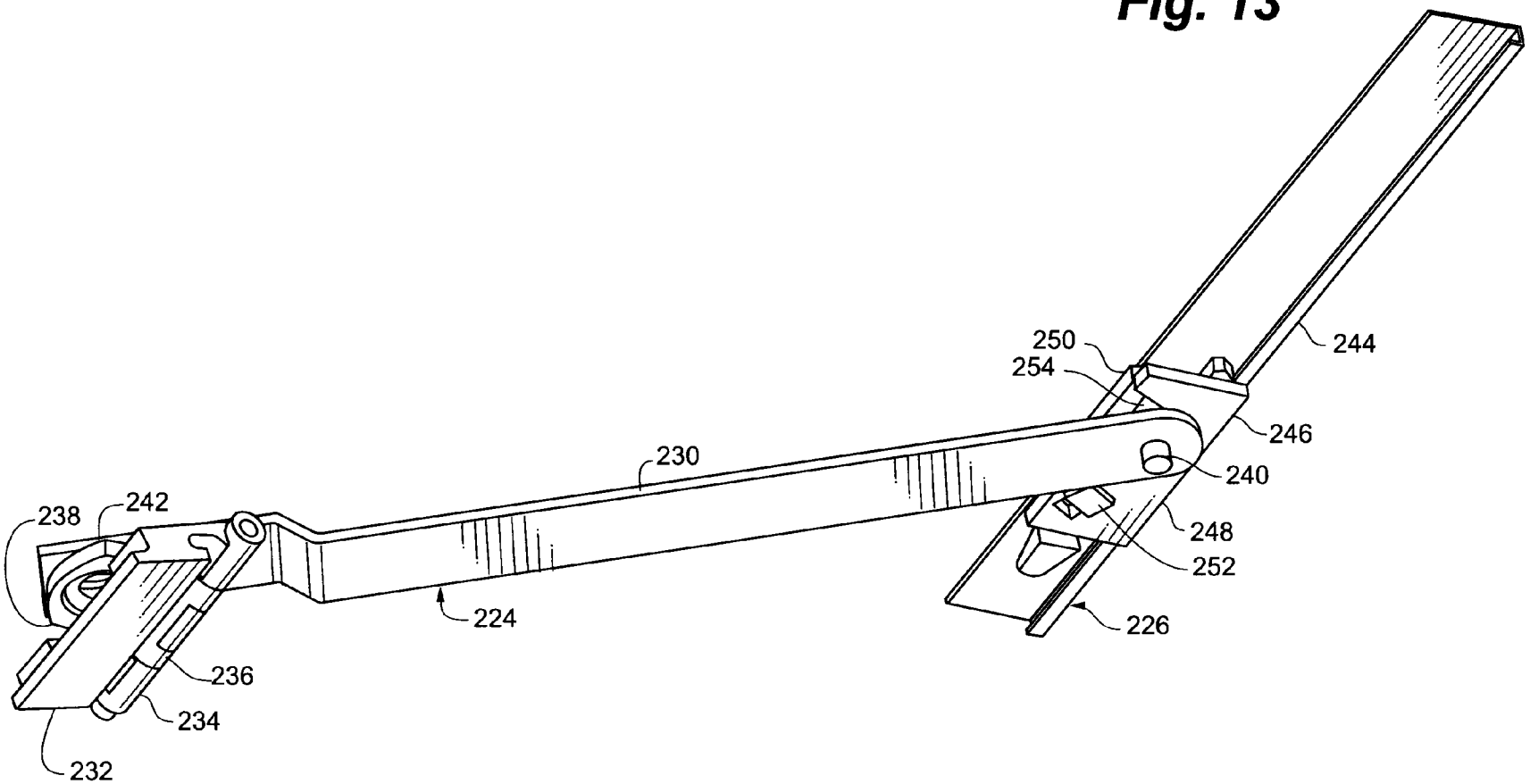
FIG. 13 is a perspective view of a window opening limit device of FIG. 11 in another orientation.

Referring to FIGS. 11-13 another example embodiment of window opening limiting device 100 is depicted. This example embodiment generally includes sash arm assembly 224 and track assembly 226. Sash arm assembly 224 generally includes sash bracket 228 and arm 230. As can be seen in FIGS. 11-13, sash bracket 228 generally includes mounting plate 232, hinge barrel 234, moving plate 236 and pivoting arm support 238. Mounting plate 232 is adapted to be secured to a window sash by screws or other fasteners. Mounting plate 232 is joined to moving plate 236 by hinge barrel 234. Moving plate 236 supports pivoting arm support 238. Pivoting arm support 238 is coupled to arm 230. Arm 230 generally includes distal coupling pin 240 and proximal pivot coupling 242.

Track assembly 226 generally includes track 244 and slider 246. Slider 246 is adapted to be coupled to track 244 in a slidable relationship. Track 244 is configured to be secured to a window frame by screws or other fasteners (not shown).

Slider 246 generally includes slider body 248, toggle latch 250 and release actuator 252. Toggle latch 250 is biased by a spring or other biasing member toward an open position in which receiving throat 254 is open outwardly and capable of receiving distal coupling pin 240 therein. Release actuator 252 is configured to secure toggle latch 250 in a closed orientation. Actuation of release actuator 252 releases toggle latch 250 so that it may travel toward its biased open position. Distal coupling pin 240 is receivable into receiving throat 254 so that when toggle latch 250 is in a closed orientation, distal coupling pin 240 is secured therein.

Figure 14:
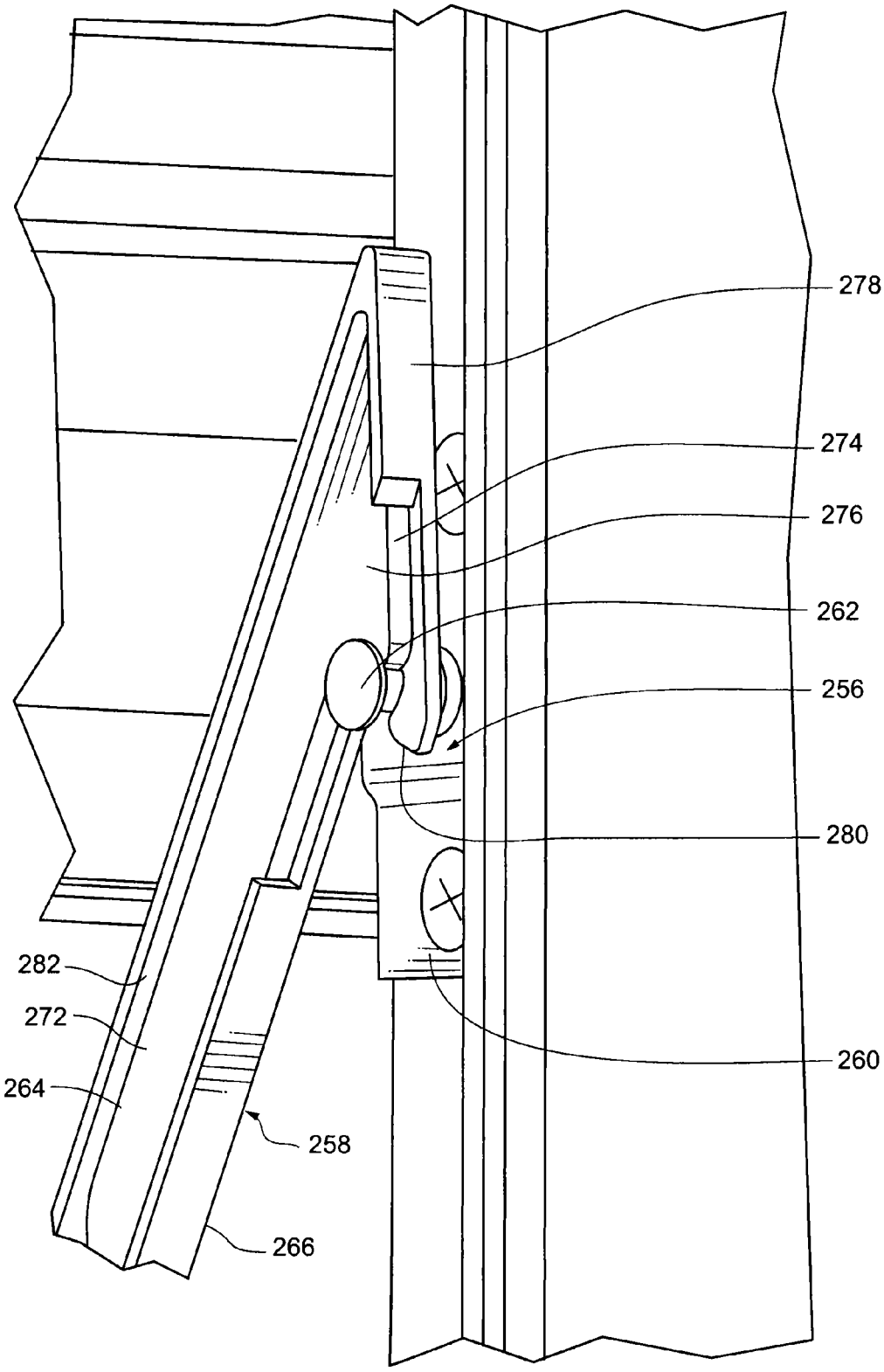
FIG. 14 is perspective view of a window opening limit device according to another embodiment of the invention, installed in a window.
Figure 15:
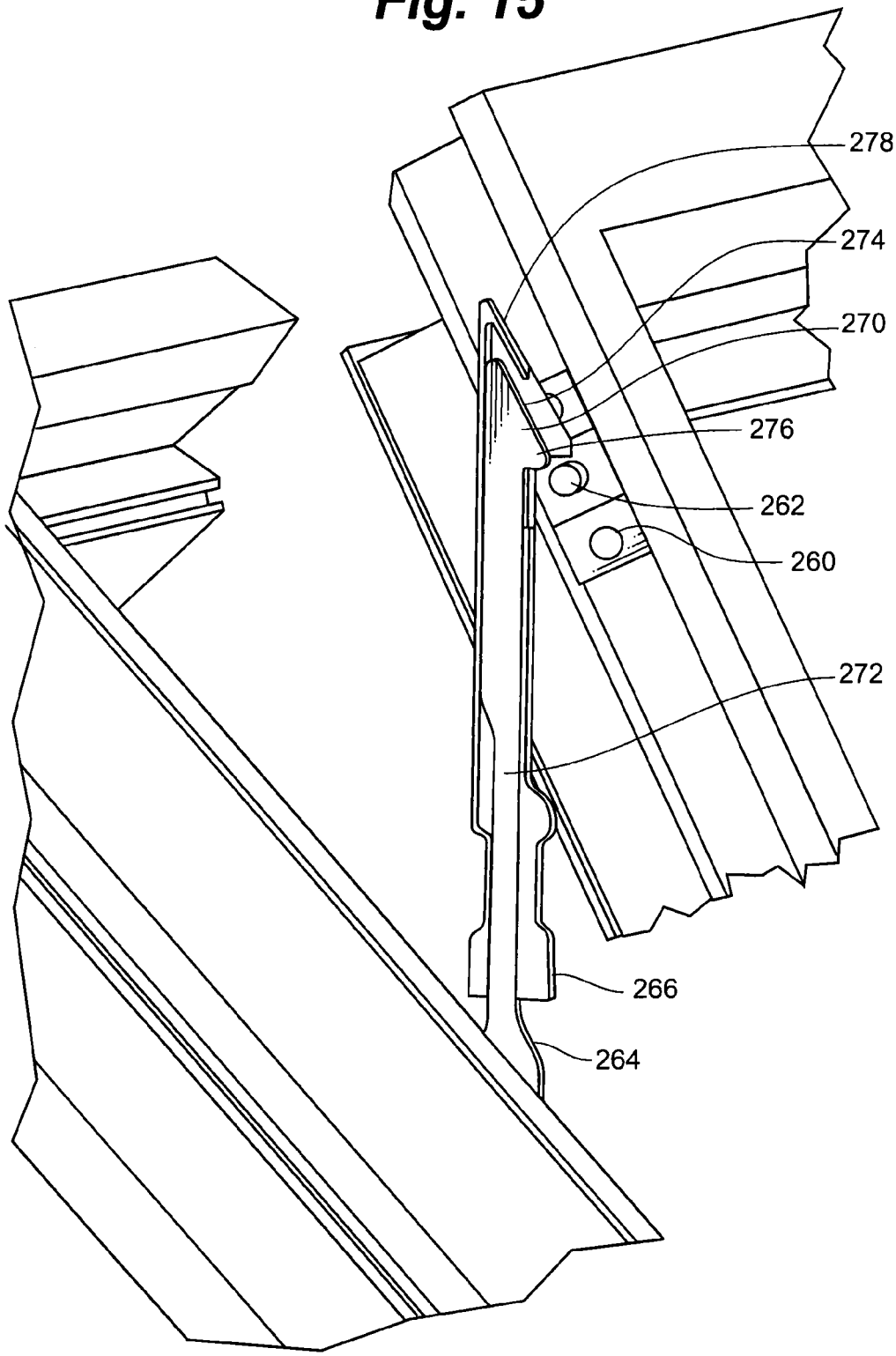
FIG. 15 is perspective view of the window opening limit device of FIG. 14 in a released configuration, installed in a window.
Figure 16:
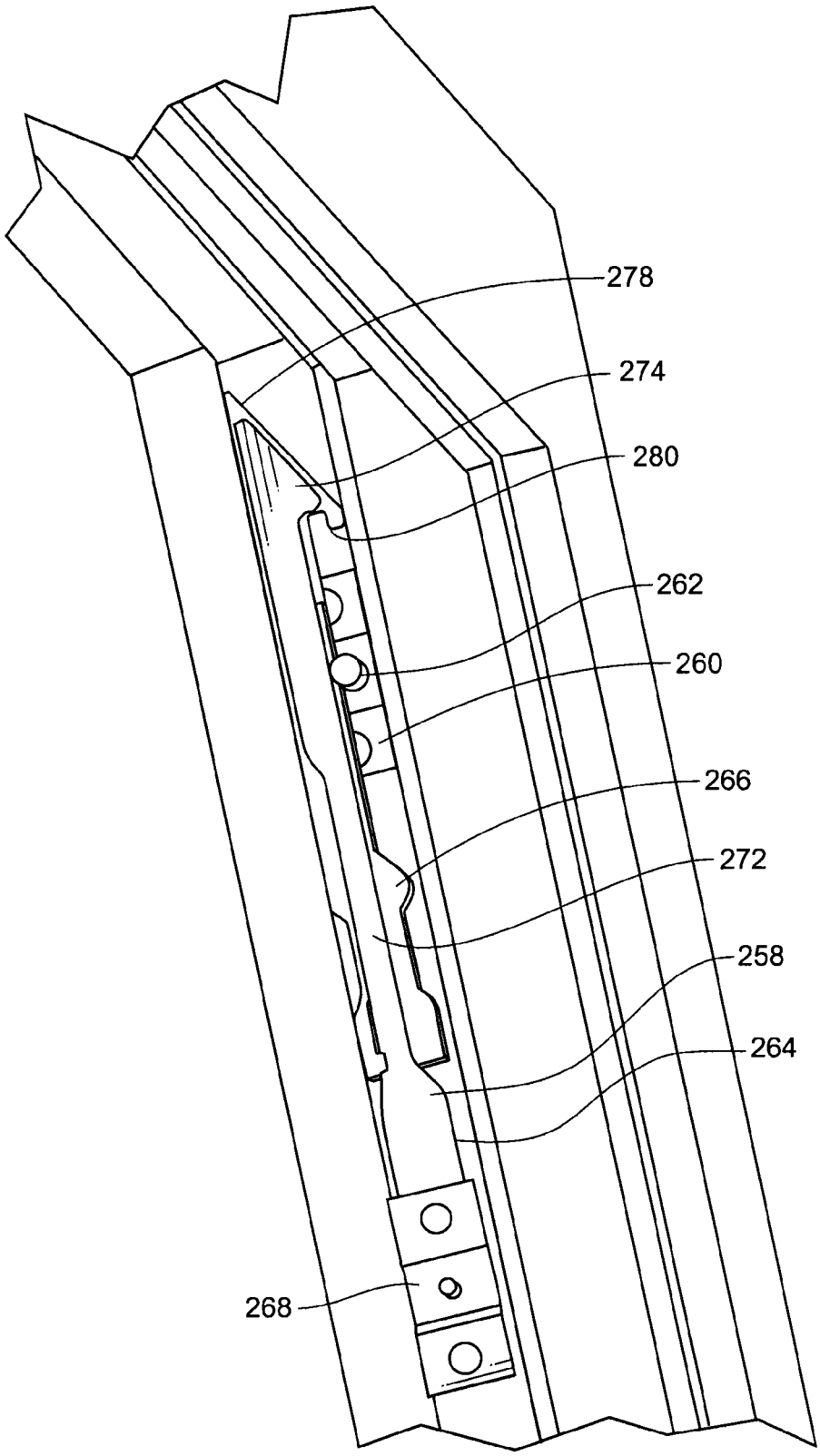
FIG. 16 is perspective view of the window opening limit device of FIG. 14 in phantom when the sash is positioned in the closed position.

Another example embodiment of the invention is depicted in FIGS. 14-16. In this embodiment, the invention generally includes frame bracket 256 and biased sash arm 258.

Frame bracket 256 generally includes mounting plate 260 and fixed pin 262. Mounting plate 260 is adapted to be secured to a surface, for example, via screws or other fasteners. Fixed pin 262 extends outwardly from mounting plate 260.

Biased sash arm 258 generally includes arm 264, slide hook 266 and sash bracket 268. Arm 264 is pivotably secured to sash bracket 268 and biased toward frame bracket 256 by a spring (not shown) or other biasing member. Arm 264, in this example embodiment, generally presents straight body 272, and at distal end 270, ramp 274 and retainer 276.

Slide hook 266 generally presents ramped portion 278, hook 280 and arm channel 282. Straight body 272 of arm 264 is received in arm channel 282 of slide hook 266 in slidable relation. Slide hook 266 is biased proximally from distal end 270 of arm 264. Biasing may be accomplished by springs or other biasing members (not shown). Ramped portion 278 is shaped to essentially conform to the outside of ramp 274. Retainer 276 is shaped so that when slide hook 266 is moved distally, retainer 276 occupies the space in hook 280. Hook 280 is sized and shaped to engage fixed pin 262 when hook 280 is under tension relative to fixed pin 262. Ramp 274 and ramped portion 278 are shaped to permit biased sash arm 258 to ride up and over fixed pin 262 when bias sash arm 258 is moved toward fixed pin 262.

Figure 17:
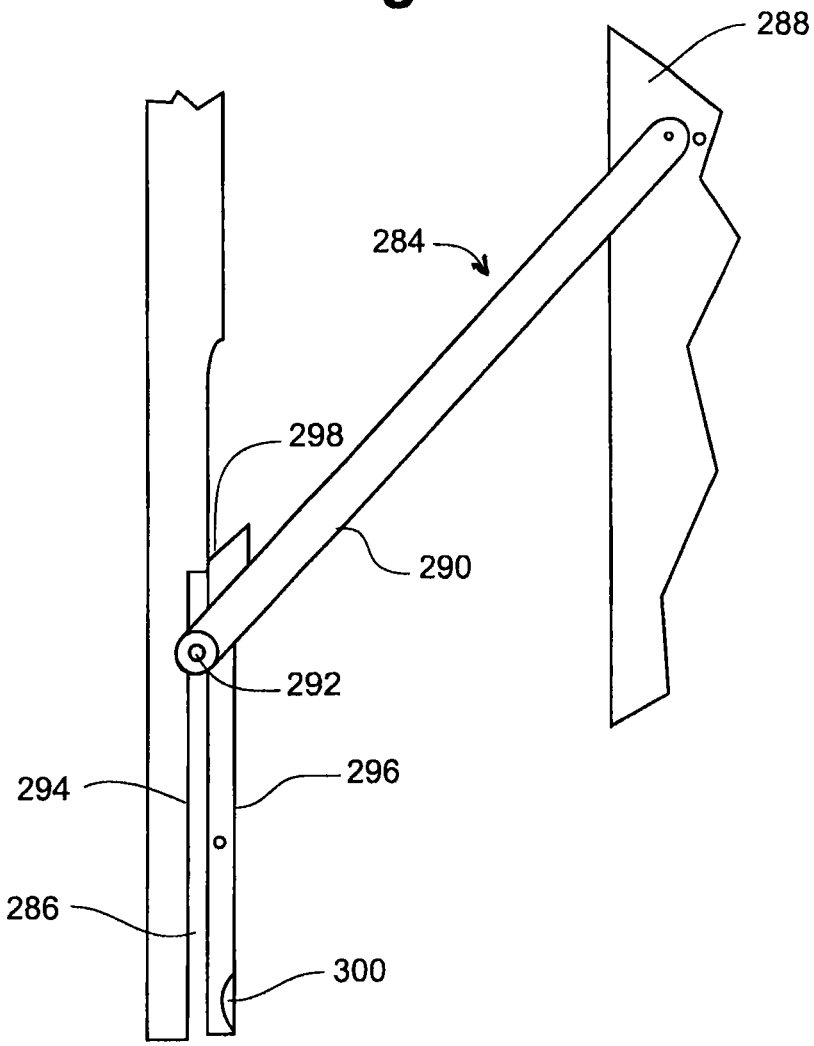
FIG. 17 is a schematic plan view of a window opening limit device according to another embodiment of the invention.
Figure 18:
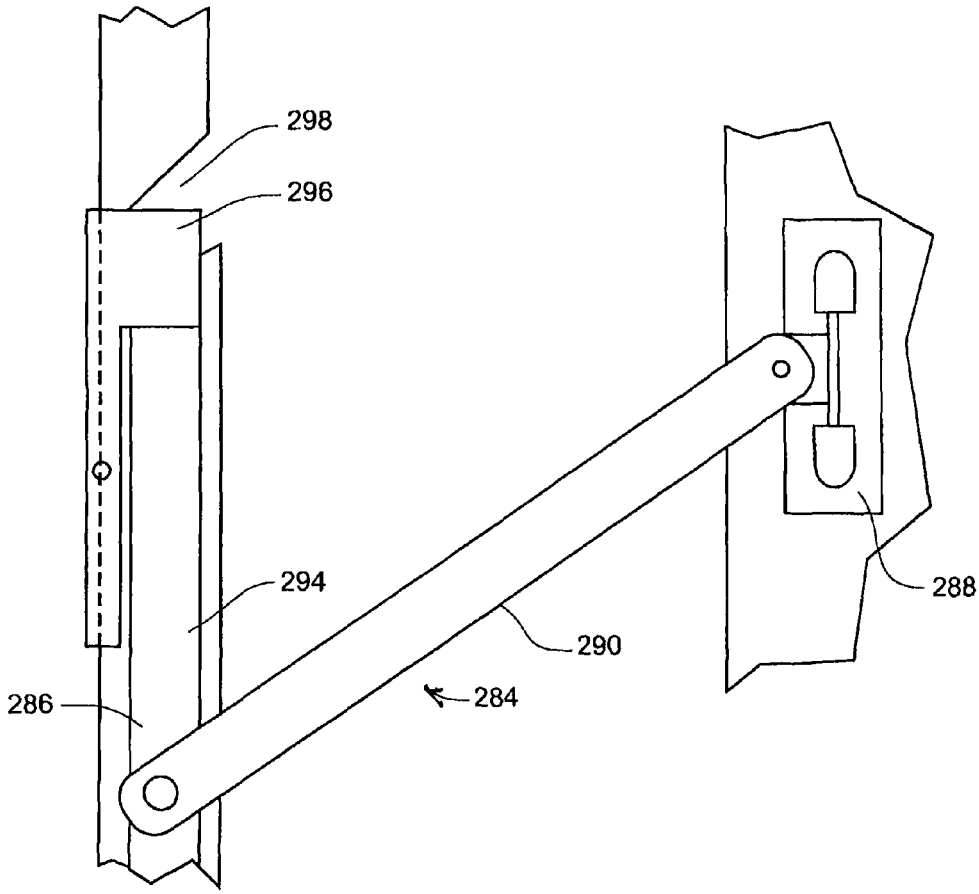
FIG. 18 is a schematic plan view of a window opening limit device according to another embodiment of the present invention.

Two similar embodiments of the invention are depicted in FIGS. 17 and 18. Because of their structural similaries, these two embodiments will be described together. The embodiments depicted in FIGS. 17 and 18, generally include a biased sash arm 284 and slide track 286. Biased sash arm 284 generally includes sash mounting plate 288, arm 290 and distal pin 292. Sash mounting plate 288 is adapted to be secured to a sash or other structure by screws or other fasteners (not shown). Arm 290 is pivotively mounted to sash mounting plate 288 and biased toward a particular desired position. Distal pin 292 is located at the distal end of arm 290. Distal pin 292 may also include a bushing or wheel or other friction reducing device thereon (not shown).

Slide track 286 generally includes track 294 and keeper 296. In this embodiment of the invention, track 294 is generally oriented parallel to the long axis of sash 114 or frame 112 when installed. Track 294 defines track entrance/exit 298 at one end thereof. Keeper 296 is secured to track 294 so that track entrance/exit 298 can be opened or closed by manipulation of keeper 296. Keeper 296 is also spring loaded so that keeper 296 can be displaced by distal pin 292 to open track entrance/exit 298 and permit entrance of distal pin 292. Further, keeper 26 is structured so that when distal pin 292 is in track 294, distal pin abuts keeper 296 and is retained within track 294.

The bias of bias sash arm 284 is such that distal pin 292 is aligned with track entrance/exit 298 when sash 114 is moved toward frame 112. Keeper 296 further includes push tab 300. Push tab 300 is positioned so that force is applied to push tab 300 will move keeper 296 to open track entrance/exit 298.

Figure 19:
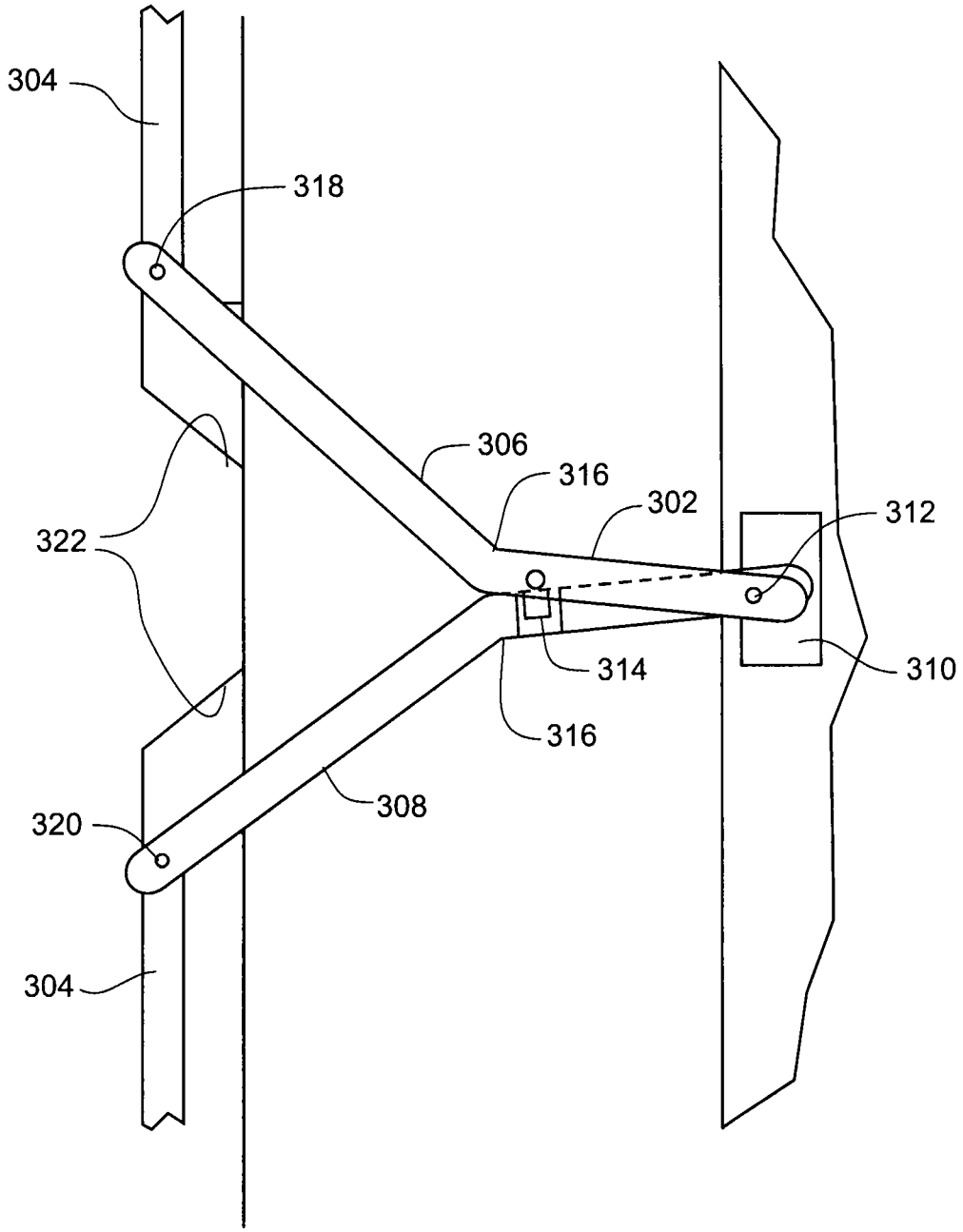
FIG. 19 is a schematic plan view of a window opening limit device according to another embodiment of the present invention.

Referring to FIG. 19, another embodiment of the invention is depicted. This embodiment includes dual arms 302 and dual slide tracks 304.

Dual arms 302 generally include first arm 306 and second arm 308. First arm 306 and second arm 308 are secured to frame bracket 310 by common pivot 312. First arm 306 and second arm 308 also include arm catch 314. As depicted in the present embodiment, first arm 306 and second arm 308 may have a bent or dog leg shape. Arm catch 314 may be located approximate bend 316 of first arm 306 and second arm 308. Arm catch 314 is structured to prevent first arm 306 and second arm 308 from passing each other when they are approximately in the orientation depicted in FIG. 19. Arm catch 314 may be released to permit first arm 306 to pass second arm 308. Arm catch 314 may also be structured to permit passage of first arm 306 pass second arm 308 in the reversed direction but with some resistance. First arm 306 and second arm 308 also include first distal pin 318 and second distal pin 320.

Dual slide tracks 304, each generally present ramp entrance/exit 322. In the depicted embodiment, dual slide tracks 304 are generally mirror images of each other. Dual slide tracks 304 are positioned so that when dual arms 302 are secured by arm catch 314, ramped entrance/exit 322 of dual slide tracks 304 are closer together than are first distal pin 318 and second distal pin 320. When arm catch 314 is released, first arm 306 and second arm 308 can be move closer together so that first distal pin 318 and second distal pin 320 are as narrow or narrower than ramped entrance/exit 322 of dual slide tracks 304.

Figure 20:
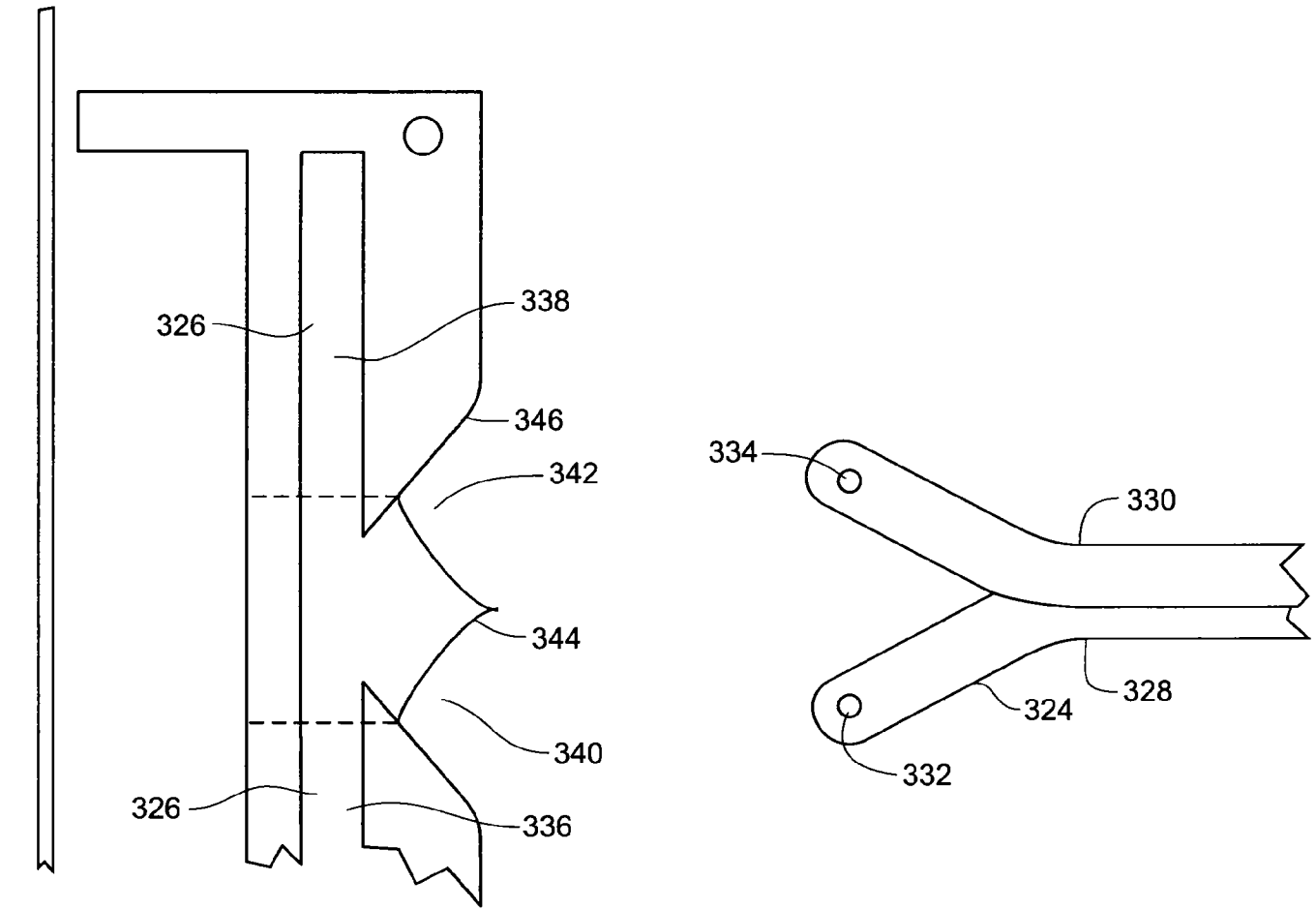
FIG. 20 is a schematic plan view of a window opening limit device according to another embodiment of the present invention.

Referring to FIG. 20 another embodiment of the invention is depicted. This embodiment includes dual arms 324 and dual slide tracks 326.

Dual arms 324 include first curved arm 328, second curved arm 330, first distal pin 332 and second distal pin 334. First distal pin 332 is at the distal end of first curved arm 328. Second distal pin 334 is at the distal end of second curved arm 330. First curved arm 328 and second curved arm 330 are biased to maintain a position similar to that depicted in FIG. 20 with first distal pin 332 and second distal pin 334 a desired distance apart.

Dual slide tracks 326 generally include first track 336, second track 338 and common entrance 340. Common entrance 340 may take the form of funnel 342. This embodiment of the invention may also optionally include keeper 344. First track 336 and second track 338 share a common long axis and meet at common entrance 340. Common entrance 340 is slightly narrower than the spacing between first distal pin 332 and second distal pin 334 when they are biased to a desired position. Funnel 342 defines ramped edges 346. Ramped edges 346 slope inwardly toward common entrance 340.

Figure 21:
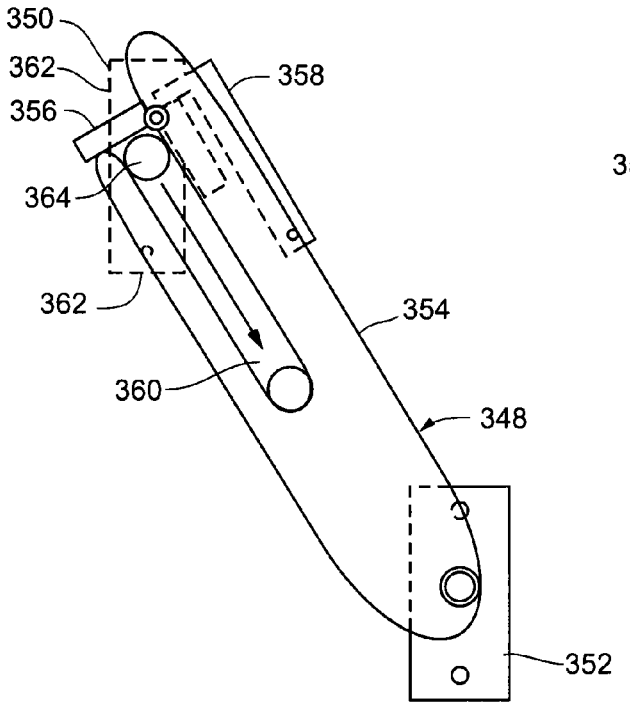
FIG. 21 is a schematic plan view of a window opening limit device according to another embodiment of the present invention in an engaged orientation.
Figure 22:
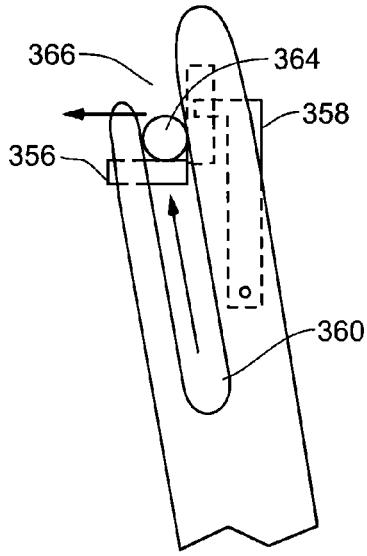
FIG. 22 is a schematic plan view of the window opening limit device of FIG. 21 in a released orientation.

Another embodiment of the invention is depicted in FIGS. 21 and 22. This embodiment of the invention generally includes U-shaped arm 348 and sash bracket 350. U-shaped arm 348 generally includes mounting plate 352, arm 354, pivoting catch 356 and catch release 358. Arm 354 is pivotally coupled to mounting plate 352 which is adapted to be secured to a surface by screws or other fasteners (not shown). Arm 354 defines longitudinal slot 360 along the length thereof. Pivoting catch 356 is located generally at a distal end of arm 354. Pivoting catch 356 is structured to close off the end of longitudinal slot 360 and to be released to open the end of longitudinal slot 360. Sash bracket 350 generally includes mounting plate 362 supporting fixed pin 364. Mounting plate 362 is adapted to be secured by screws or other fasteners to a surface. Fixed pin 364 is appropriately sized to be received in longitudinal slot 360. Pivoting catch 356 is structured so that when fixed pin 364 abuts pivoting catch 356 from outside of longitudinal slot 360, fixed pin 364 forces pivoting catch 356 to permit fixed pin to enter longitudinal slot 360 and to move pivoting catch 356 to a closed position. Pivoting catch 356 is secured in the closed position by catch release 358. Arm 354 is biased at mounting plate 352 to assume a desired position so that fixed pin 364 is aligned with pivoting catch 356 at entrance 366 of longitudinal slot 360.

In operation, window opening limiting device 100 can be used in any number of ways. In the embodiment depicted in FIGS. 1-6, device 100 can be mounted in window such as casement window 110 depicted in FIG. 3. In general, sash 114 of casement window 110 is shiftable between a closed and fully opened position. In the closed position, sash 114 is positioned within frame 112 such that sash 114 substantially fully occupies window opening 124. In the fully opened position, the angle formed by bottom 128 of sash 114 and sill 120 of frame 112 is maximized, such as, for example, by the configuration of operator mechanism 116 or interference between side rail 130 of sash 114 and side 122 of frame 112 (which may occur, for example, when sash 114 is released from the sash arm of operator assembly 116). In an example embodiment of the invention, device 100 defines a limited position intermediate the closed and fully opened positions wherein the sash is partially open with respect to frame 112. As used herein, the limited position can be numerically described by the minimum distance between the corresponding side rail 130 and side 122. In an example embodiment, when device 100 is engaged, sash 114 is shiftable between the closed position and the limited position but cannot be shifted between the limited position and fully opened position during normal operation. When device 100 is disengaged, sash 114 is shiftable between the closed position beyond the opening limited position and to the fully opened position.

Referring to FIGS. 1-2 and 4-6, sash bracket 102 is generally mounted to sash 114 and track 106 is generally static-mounted to frame 112. In this example, sash bracket 102 is coupled to side rail 130 of sash 114 and track is coupled to side 122 of frame 112. According to this embodiment, sash bracket 102 is positioned higher than track jamb 106 with respect to sill 120 and bottom 128. In an alternative embodiment, sash bracket 102 is coupled to bottom 128 of sash 114 and track 106 is coupled to sill 120 of frame 112. A possible disadvantage of this mounting arrangement can be interference between device 100 and existing window hardware. In another example embodiment, device 100 can be retrofitted onto casement window 110 that has already been installed in a structure. In an alternative embodiment, device 100 can be installed onto casement window 100 before casement window 100 is installed in the structure.

A feature and advantage of installing device 100 on side rail 130 and side 122 is that sash bracket 102 and track 106 are variably positionable with respect to sash 114 and frame 112 on casement windows of different dimensions while maintaining a substantially uniform opening limited position. In contrast, if device 100 is installed on sill 120 and bottom 128, device must be positioned distal to the hinges and proximal the corners formed by sill 120 and side 122, and bottom 128 and side rail, respectively.

When sash 114 is in the closed position, biasing member 142 exerts a force upon distal end 150 of limiting arm 104. This causes slide wheel 158 to occupy engagement region 182 of track 106. In particular, the force exerted by biasing member 142 urges slide wheel 158 toward the inner portion of beveled edge 178 or primary flange 170 and away from beveled edge 178 of secondary flange 172.

As sash 114 is opened, sash bracket 102 shifts away from track 106. Since limiting arm 104 is coupled to sash bracket 102, this causes distal end 150 of limiting arm 104 to follow sash bracket 102. Slide wheel 158 travels along channel 186 from engagement region 182 toward disengagement region 184. As slide wheel 158 approaches disengagement region 184, distal end 150 of limiting arm 104 is pulled away from biasing member 142. In an example embodiment, distal end 150 of limiting arm 104 is not pulled away from biasing member at least until slide wheel has cleared engagement region 182 and occupies channel 186. At this point, lips 184 of primary and secondary flanges 172, 174 retain slide wheel 158 within channel 186. This process can be reversed by returning sash 114 to the closed position.

When sash 114 reaches the opening limited position, slide wheel 158 is positioned within channel 186 proximate stop 176. Limiting arm 104 is prevented from disengaging from track 106 by abutment of slide wheel 158 to stop 176. In this orientation stop 176 blocks slide wheel 158 from exiting channel 186 through disengagement region. In this manner, sash 114 cannot be opened any further because slide wheel 158 of limiting arm 104 cannot move through channel 186 in a direction away from sill 120 toward head jamb 118. The limited position can be varied by utilizing limiting arms 104 of different lengths. For example, increasing the length of limiting arm 104 will cause the limited position to be closer to the fully opened position, and vice versa.

In the example embodiment, limiting arm 104 can be disengaged from track 106 so that sash 114 is shiftable from the opening limited position to the fully opened position. When it is desired to open the window beyond the opening limited position, a user can apply pressure to stop 176 so that stop 176 is shifted toward main plate 170 of track 106. This creates a gap between stop 176 and primary and secondary flanges 170, 172 through which slide wheel 158 can pass. As sash 114 is opened further, slide wheel 158 enters disengagement region 184 of track 106 and then exits track 106 entirely. Since secondary flange 172 is not present in disengagement region 184, limiting arm 104 can disengage from track 104.

A feature and advantage of the above mechanism for releasing limiting arm 104 from track 106 is that it requires two points of activation. In particular, a user must exert a force upon stop 176 while simultaneously guiding slide wheel 158 through channel or pushing sash 114. Such a releasing procedure, that requires multiple simultaneous actions, reduces the likelihood of inadvertent operation, such as, for example, by a child. In an alternative embodiment, device 100 includes a biased triggering mechanism (not shown) that allows limiting arm 104 to be released from inside frame 112. Device 100 may include any number of mechanisms that allow limiting arm 104 to be released from track 106.

Limiting arm 104 reengages with track 106 as sash 114 is returned to the closed position. As sash 114 is shifted to the closed position, side rail 130 of sash 114 and/or track 106 cause limiting arm 104 to move toward a generally vertical orientation (with respect to embodiments in which track jamb 106 is mounted onto side rail 130 and sash bracket 102 is mounted onto side 122). Stabilizer head 144 generally limits transverse movement of limiting arm 104 as sash 114 is shifted toward the closed position. When sash 114 reaches the closed position, biasing member 142 and stabilizer head 144 guide and urge slide wheel 158 into engagement region 150 of limiting arm 106. Limiting arm 106 is thereby positioned to engage channel 186 when sash 114 is once again opened. A feature and advantage of the present invention is limiting arm 104 automatically reengages track 106 upon closing. Therefore, if the user forgets that the limiting arm 104 was disengaged from track 106, and a new user was not aware of this action, device will return to the function of limiting opening of sash 114 once sash is returned to the closed position.

Referring to FIGS. 7-10, in operation of the depicted embodiment of the invention, sash arm 186 and frame arm 190 are biased by position biasing members 194 and 204 so that coupling pin 198 is generally aligned with receiving hook 208. When sash 114 is moved toward frame 112, coupling pin 198 contacts slider lock 206 and causes slider lock 206 to retract and coupling pin 198 to enter receiving hook 208. Slider lock 206 then returns to its former position because of biasing spring members 216. Coupling pin 198 is then secured within receiving hook 208 by slider lock 206 and sash 114 is prevented from opening beyond a preselected opening limited position.

When it is desire to open the window farther, an individual operating the window can grasp slider lock 206 and slide it away from receiving hook 208 to release coupling pin 198 from receiving hook 208. Sash 114 is then released by window opening limiting device 100 and can be opened to its full extent.

Referring now to FIGS. 11-13, in this embodiment of the invention, as sash 114 is opened relative to frame 112, arm 230 pulls on slider 246 to which it is secured. Slider 246 moves along track 244 until arm 230 reaches its most direct extension. Sash 114 has then reached its window opening limited position. When it is desired to open the window farther, an individual operating the window may actuate release actuator 252 which permits toggle latch 250 to open because of its biased arrangement. When toggle latch 250 opens, distal coupling pin 240 is released from toggle latch 250 and sash 114 may now be extended to its fully open position. In this embodiment of the invention, hinge barrel 234 allows movement between mounting plate 232 and moving plate 236 to accommodate movement of arm 230 relative to sash 114. Pivoting arm support 238 permits pivoting of arm 230 relative to mounting plate 232 and moving plate 236. When sash 114 is closed from its fully open position, arm 230 is positioned so that distal coupling pin 240 is aligned with receiving throat 254 of toggle latch 250. As the window is closed and toggle latch 250 is pushed inwardly, release actuator 252 activates to secure toggle latch 250 in the closed position. As sash 114 is closed farther, slider 246 slides along track 244 until window sash 114 is fully closed and window opening limiting device 100 of this embodiment is prepared for a next opening of the window.

Referring to FIGS. 14-16, in the depicted embodiment of the invention, as sash 114 is opened, biased sash arm 258 bears against fixed pin 262 until hook 280 of slide hook 266 engages fixed pin 262. At this point, sash 114 is limited from opening farther.

When it is desired to open sash 114 beyond this position, an individual operating the window can grasp slide hook 266 and pull it away from fixed pin 262. Arm 264 is now released from fixed pin 262 and sash 114 can be opened to its full extent. When sash 114 is closed, biased sash arm 258 is positioned so that ramped portion 278 contacts frame 112. Bias sash arm 258 slides along frame 112 until ramped portion 278 of slide hook 266 contacts fixed pin 262. Ramped portion 278 then slides over fixed pin 262 and sash 114 is permitted to close farther until the position depicted in FIG. 16 is achieved. At this point, this embodiment of the invention is ready to be open again and provide only limited opening of the window.

Referring to FIGS. 17 and 18, in the embodiments depicted herein as the window is opened and arm 290 is extended, distal pin 292 slides up track 294 until it abuts keeper 296 at track entrance/exit 298. Sash 114 has now reached its window opening limited position. When it is desired to open the window farther, an individual operating the window may press on pushtab 300 to slidably or pivotably move keeper 296 to open track entrance/exit 298. Sash 114 may then be opened to its fully open position.

As sash 114 is closed, arm 290 is held by bias in a position so that distal pin 292 is aligned with track entrance/exit 298. As sash 114 is closed, distal pin 292 contacts keeper 296 and displaces keeper 296 so that distal pin 292 enters track 294. As sash 114 is further closed, distal pin 292 travels down track 294 and window opening limiting device 100, according to these embodiments of the invention, is prepared for another opening of the window to limit its opening extent.

Referring to FIG. 19, in operation of in this embodiment of the invention, as sash 114 is opened, first distal pin 318 and second distal pin 320 each travel along dual tracks 304 toward each other. When first arm 306 and second arm 308 reach approximately the position depicted in FIG. 19, arm catch 314 prevents further movement of first arm 306 relative to second arm 308. First distal pin 318 and second distal pin 320 are each engaged in dual slide tracks 304 and sash 114 has reached it window opening limited position.

When it is desired to open the window farther, an individual operating this embodiment of the invention, releases arm catch 314 which permits first arm 306 and second arm 308 to move past each other which permits first distal pin 318 and second distal pin 320 to exit ramped entrance/exit 322 of dual slide tracks 304. Sash 114 may now be open to its full extent. As sash 114 is closed, first distal pin 318 and second distal 320 are held in a position aligned with ramped entrance/exit 322. As sash 114 continues to close, dual slide tracks 304 contact first distal pin 318 and second distal 320 and overcome the bias of arm catch 314 causing first distal pin 318 and second distal 320 to slide down dual slide tracks 304. Arm catch 314 is now reset to a position where it will stop movement of first arm 306 relative to second arm 308. First distal pin 318 and second distal pin 320 move down dual slide tracks 304 as sash 114 continues to close. Window opening limiting device 100 of this embodiment of the invention is then prepared for another operation of the window.

Referring to the embodiment depicted in FIG. 20, as sash 114 is opened, first curved arm 328 and second curved arm 330 move toward each other as first distal pin 332 and second distal pin 334 move down first track 336 and second track 338 respectively. First curved arm 328 and second curved arm 330 reach their greatest axial extent while first distal pin 332 and second distal pin 334 are still within first track 336 and second track 338 respectively. Sash 114 is then limited at its window opening limiting position.

When it is desired to open sash 114 farther, an individual operating this embodiment of the invention grasps first curved arm 328 and second curved arm 330 and presses them together against spring bias thus positioning first distal pin 332 and second distal pin 334 within common entrance 340. Sash 114 can then be opened to its full extent.

As sash 114 is closed, spring bias holds first curved arm 328 and second curved arm 330 so that first distal pin 332 and second distal pin 334 encounter funnel 342 and are pressed inward by ramped edges 346 against bias. When sash 114 has moved far enough, first distal pin 332 and second distal pin 334 are located within first track 336 and second track 338. As sash 114 is closed further, first distal pin 332 travels down first track 336 and second distal pin 334 travels down second track 338 and window opening limiting device 100 of this embodiment of the invention is prepared to limit the opening of the window on its next actuation.

Referring to FIGS. 21 and 22, the embodiment depicted here is depicted in FIG. 21 in an engaged position. As sash 114 is opened, fixed pin 364 travels down longitudinal slot 360 until fixed pin 364 encounters pivoting catch 356. Upon abutting pivoting catch 356, fixed pin 364 is prevented from traveling farther and sash 114 has reached its window opening limited position.

When it is desired to open sash 114 farther, an individual operating this embodiment of the invention activates catch release 358 which releases pivoting catch 356 and permits fixed pin 364 to exit longitudinal slot 360. Sash 114 may then be open to its full extent. Biasing holds U-shaped arm 348 in a position so that when sash 114 is closed, fixed pin 364 encounters pivoting catch 356. As fixed pin 364 forces pivoting catch 356 inwardly, catch release 358 secures pivoting catch 356 in the closed orientation so that fixed pin 364 is secured in longitudinal slot 360. This embodiment of the invention is then reset to limit the opening of sash 114 again to the window opening limited position.

In the embodiment depicted in FIGS. 23-31, window opening limit device 400 is installed on casement window assembly 402, which includes frame portion 404 and operable sash 406. Window opening limit device 400 generally includes sash bracket 408, limiting arm 410, and track assembly 412.

Figure 23:
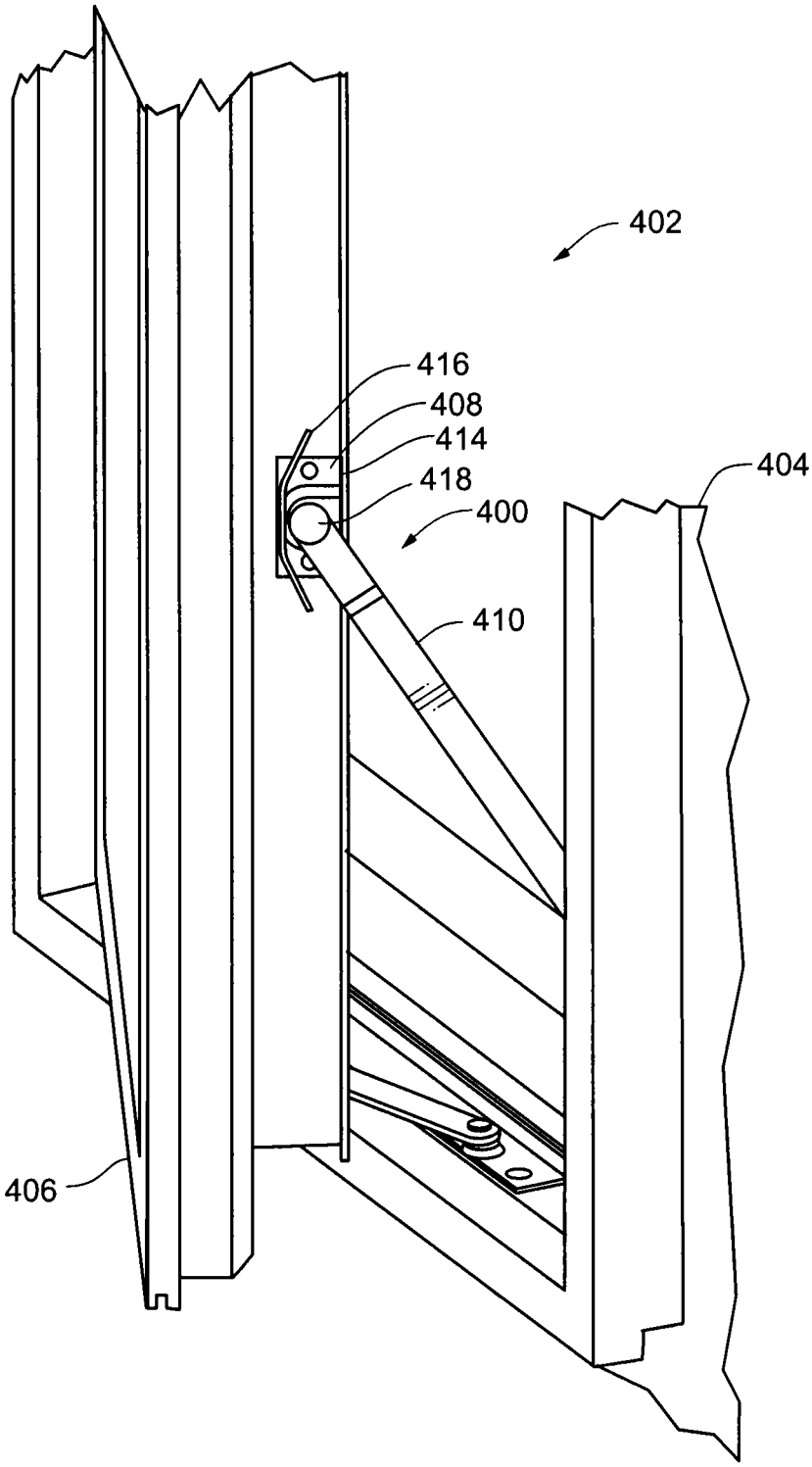
FIG. 23 is a perspective view of a window opening limit device according to an embodiment of the invention installed in a casement window.
Figure 24:
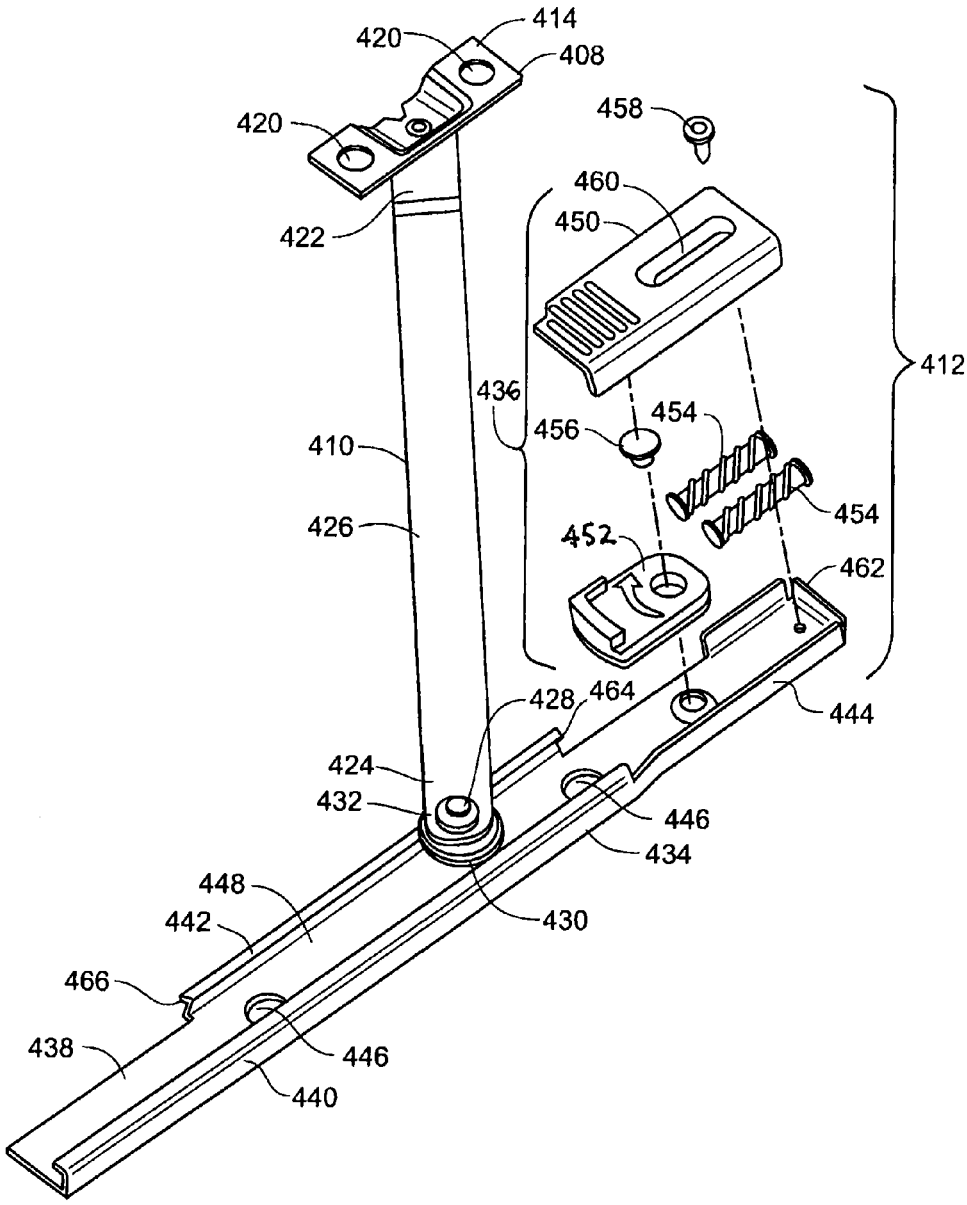
FIG. 24 is a perspective, exploded view of the window opening limit device of FIG. 23.

Referring to FIGS. 23 and 24, sash bracket 408 generally includes mounting bracket 414, biasing member 416, and pivot member 418. Sash bracket 408 may also define mounting apertures 420. Generally, sash bracket 408 is structured to have a low-profile such that pivot member 418 does not extend beyond the outermost edge of the side rail of the sash to which sash bracket 408 is mounted.

Limiting arm 410 presents proximal end 422, distal end 424, and main section 426 extending between distal and proximal ends 422, 424. Proximal end 422 is pivotably coupled to sash bracket 408, and may be slightly offset from main section 426, as depicted in FIGS. 23-24. Distal end 424 generally includes engagement structure 428 adapted to releasably engage track assembly 412. In an exemplary embodiment, engagement structure 428 may be slide wheel 430 that is rotatable on axle 432.

Track assembly 412 generally includes track 434 and release assembly 436. Track 434 generally includes main plate 438, primary flange 440, secondary flange 442, and release mechanism housing portion 444. Main plate 438 defines apertures 446 adapted to receive fastening members (not shown) for coupling track assembly 412 to frame portion 404. Main plate 438, primary flange 440, and secondary flange 442 define channel 448 adapted to receive slide wheel 430.

Release assembly 436 generally includes slide 450, pivot stop 452, and compression springs 454. Pivot stop 452 is pivotally attached to track 434 with pivot 456. Slide 450 is slidably received over release mechanism housing portion 444 of track 434, and is secured with rivet 458 through slot 460. Compression springs 454 are received in release mechanism housing portion 444, and bear against end wall 462, and a bulkhead (not depicted) defined within slide 450, such that slide 450 is biased away from end wall 462.

Figure 25:
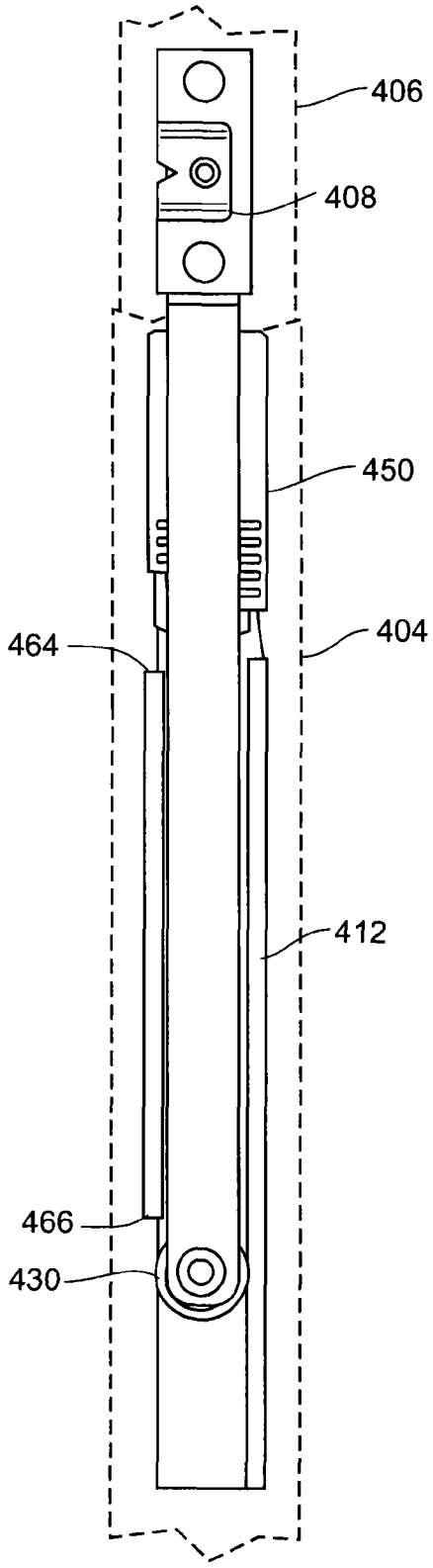
FIG. 25 is a side elevation view of the window opening limit device of FIG. 23 depicted in a window-closed position.

The operation of window opening limit device 400 is depicted in FIGS. 25-31. With casement window assembly 402 in the window closed position as depicted in FIG. 25, wherein operable sash 406 is received in frame portion 404, limiting arm 410 is substantially aligned with track 434. Slide wheel 430 is biased against primary flange 440 by biasing member 416, and is registered with the bottom end of channel 448.

Figure 26:
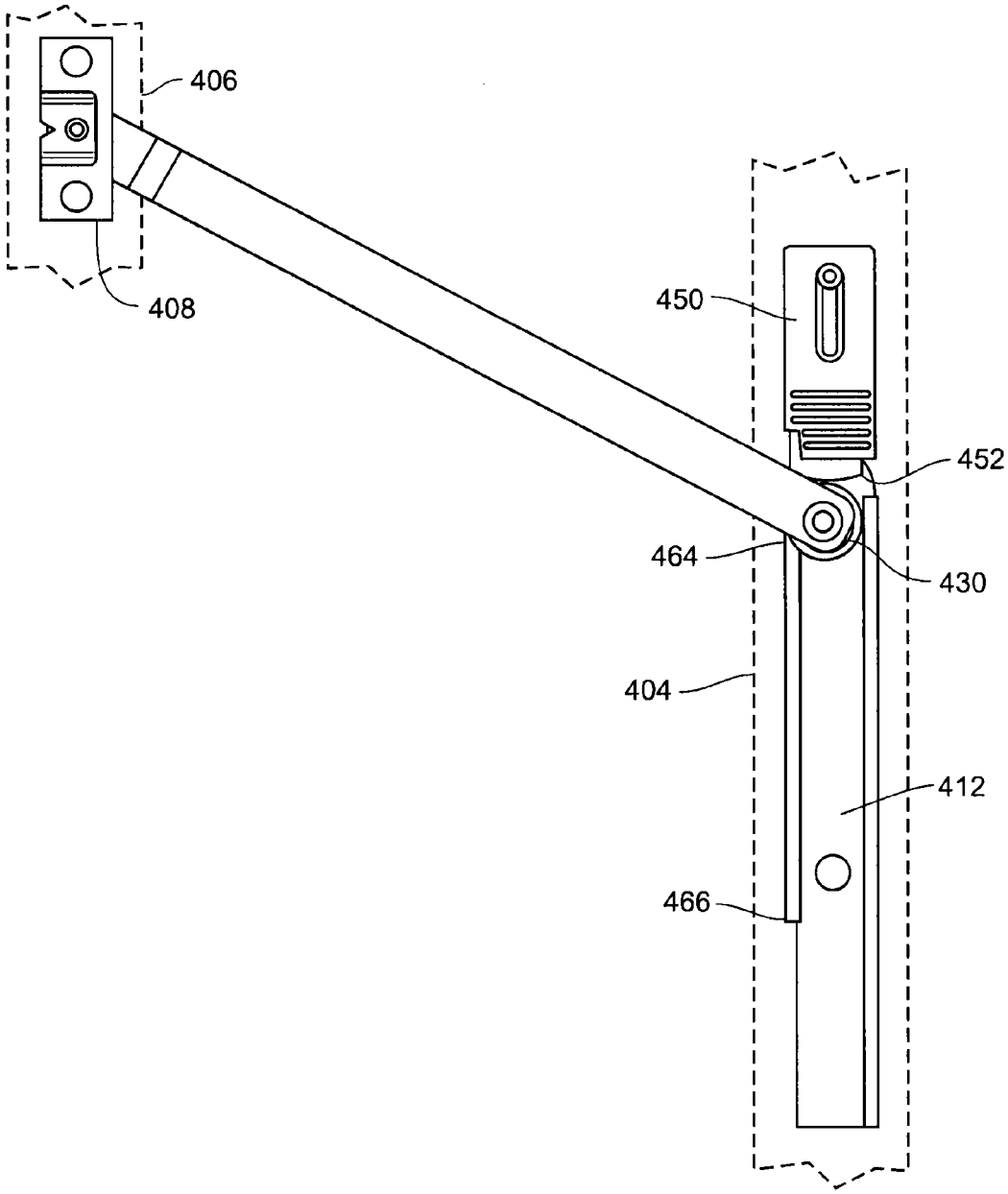
FIG. 26 is a side elevation view of the window opening limit device of FIG. 23 depicted in a window-open, travel-limited position.

As sash 406 is pivoted away from frame portion 404, slide wheel 430 is urged against primary flange 440 through the bias of biasing member 416, and as a result, slide wheel 430 rides upward in channel 448. Slide wheel 430 eventually contacts pivot stop 452 as depicted in FIG. 26. In this position, slide wheel 430 is inhibited from moving further upward in channel 448 by pivot stop 452, which is positioned such that slide wheel 430 cannot pass between pivot stop 452 and upper end 464 of secondary flange 442 when pivot stop 452 is positioned in the blocking position.

Figure 27:
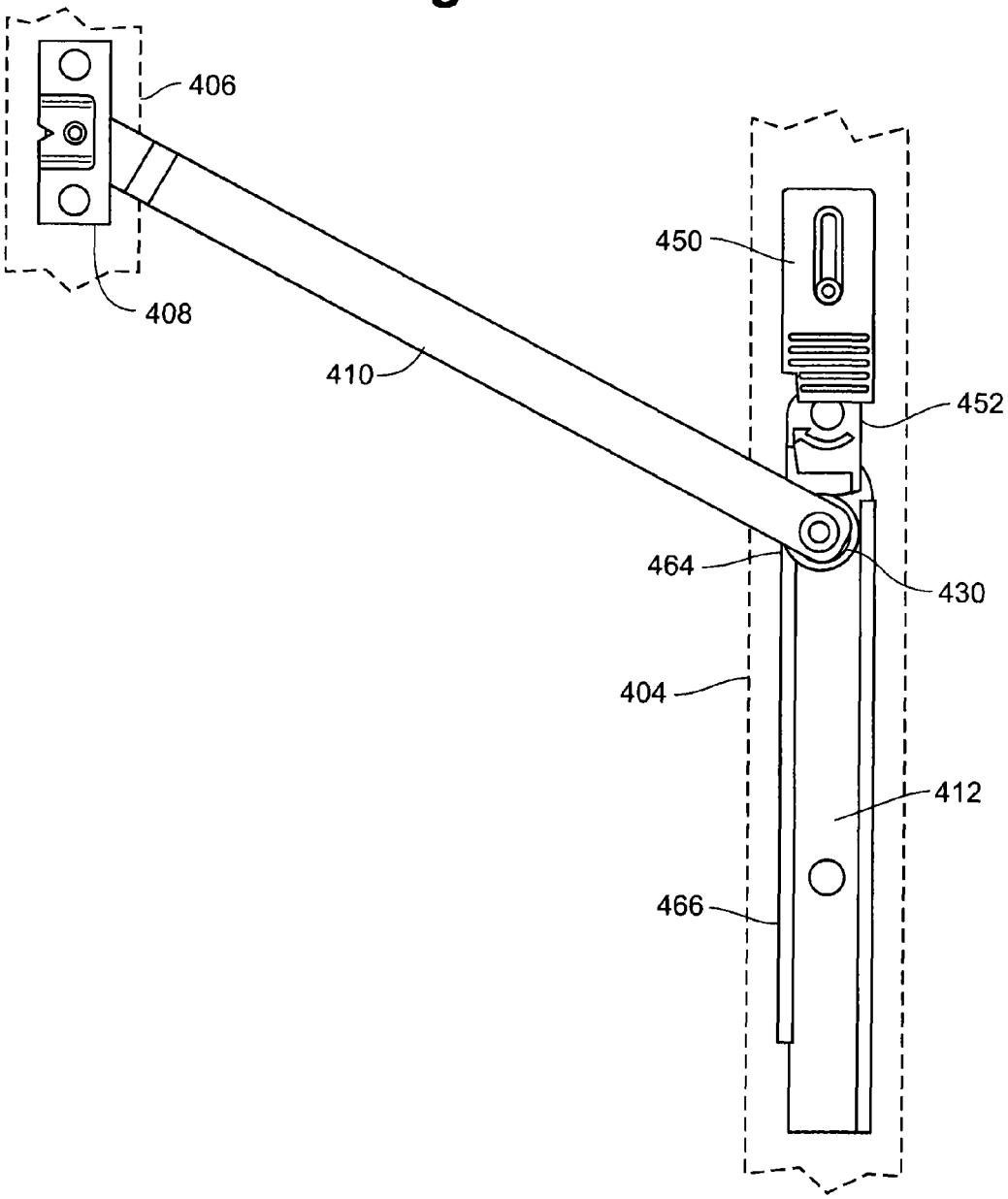
FIG. 27 is a side elevation view of the window opening limit device of FIG. 23 depicted in a window-open, travel-limited position, and with the release mechanism depicted after completion of a first release action.
Figure 28:
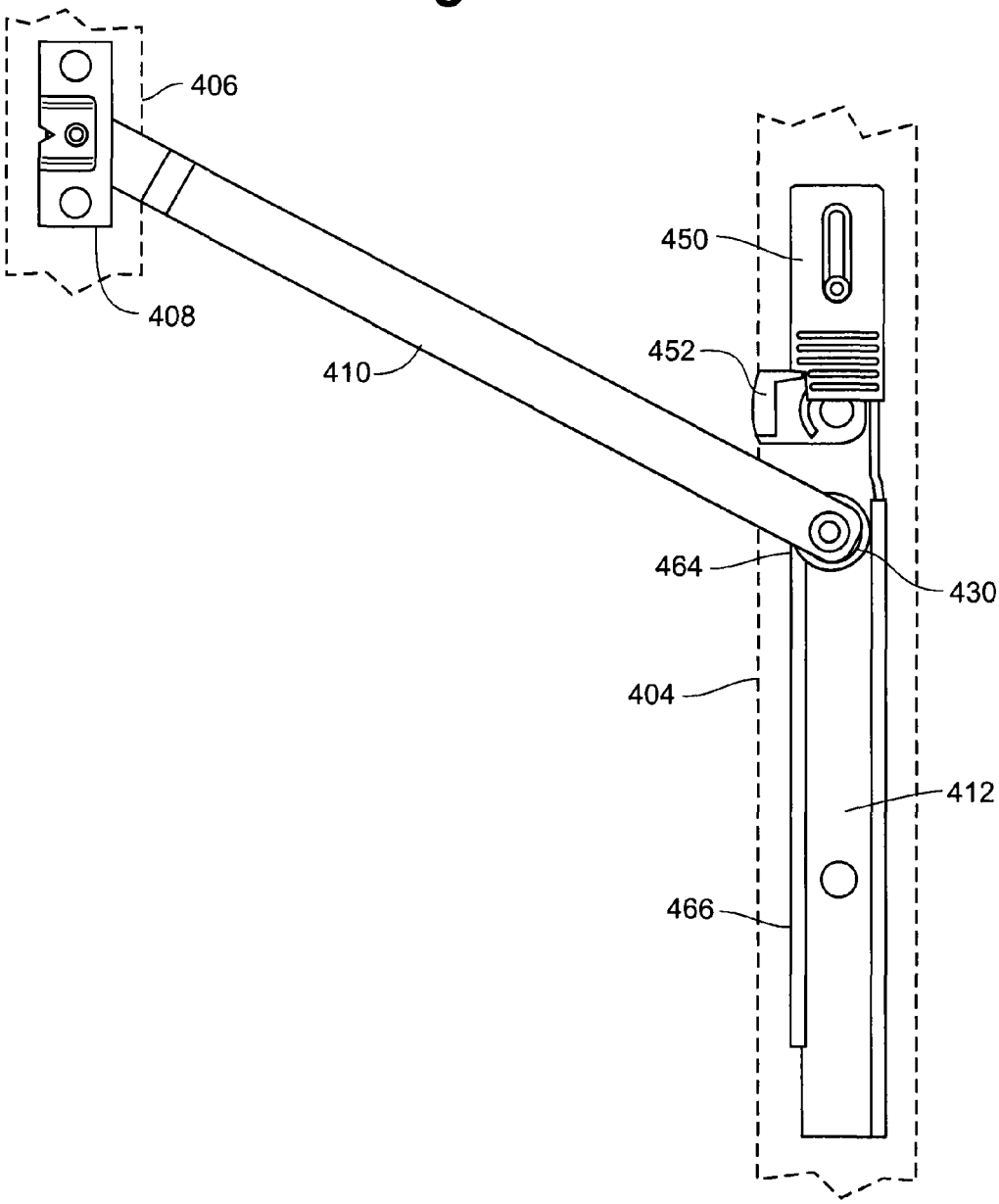
FIG. 28 is a side elevation view of the window opening limit device of FIG. 23 depicted in a window-open position, and with the release mechanism depicted after completion of a second release action.
Figure 29:
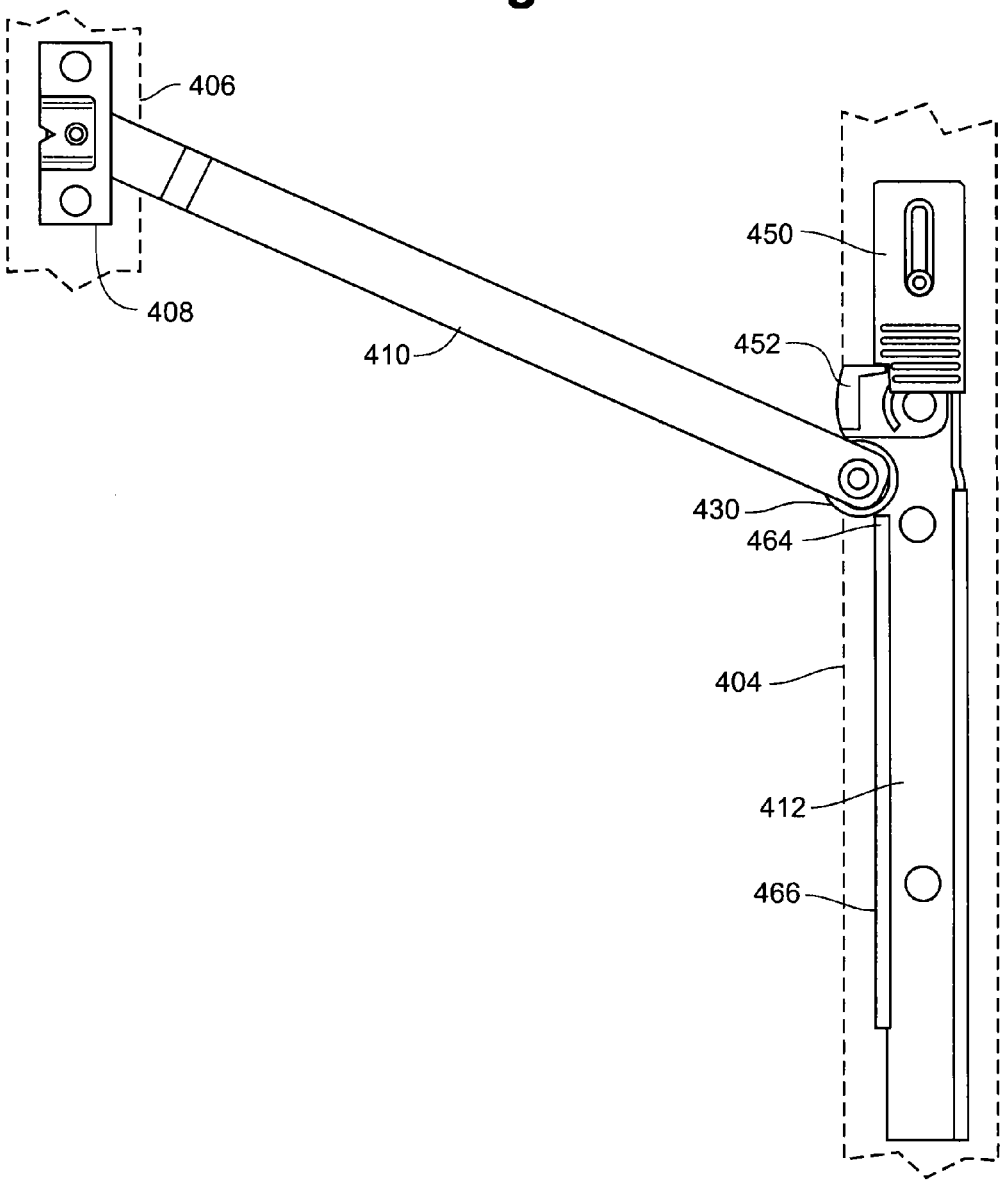
FIG. 29 is a side elevation view of the window opening limit device of FIG. 23 depicted in a window-open position, and with the limiting arm exiting from engagement with the track.

As depicted in FIGS. 27-29, limiting arm 410 can be released from track assembly 412 in order to enable sash 406 to be opened more fully by operation of release assembly 436. First, as depicted in FIG. 27, slide 450 is slid upward against the bias of compression springs 454 to expose pivot stop 452. Then, in a separate action, pivot stop 452 is pivoted clockwise from the blocking position to a non-blocking position as depicted in FIG. 28. In this position, the gap between pivot stop 452 and upper end 464 of secondary flange 442 is large enough to permit slide wheel 430 to pass through, thereby releasing limiting arm 410 from track assembly 412.

Figure 30:
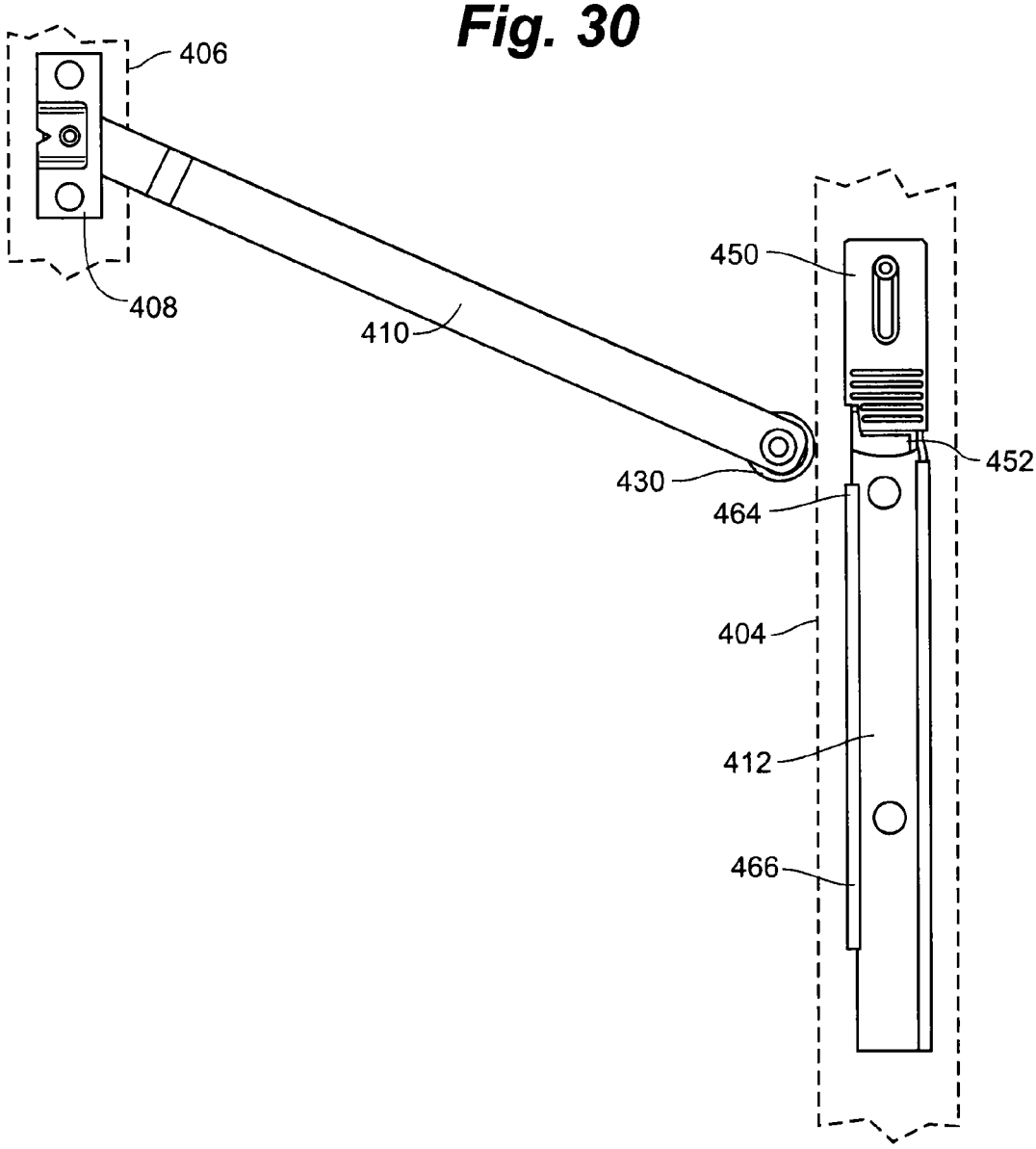
FIG. 30 is a side elevation view of the window opening limit device of FIG. 23 depicted in a window-open position, and with the limiting arm fully clear of the track.
Figure 31:
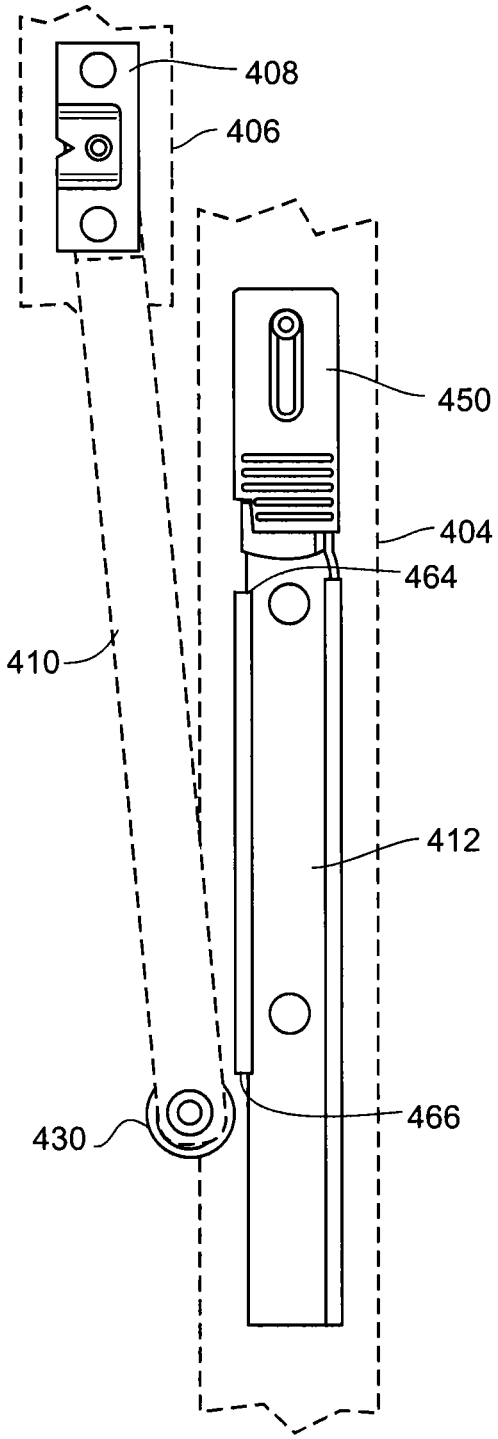
FIG. 31 is a side elevation view of the window opening limit device of FIG. 23 depicted in a window-open position but with the sash closing toward the frame, and with the limiting arm approaching engagement with the track.

As depicted in FIG. 30, once limiting arm 410 has been released, the bias of compression springs 454 can be permitted to urge slide 450 downward, simultaneously pivoting pivot stop 452 back to the blocking position. When sash 406 is closed, slide wheel 430 rides under bottom end 466 of secondary flange 442, as depicted in FIG. 31, eventually returning to the position depicted in FIG. 25 when sash 406 is fully closed. Hence, window opening limit device 400 is self-resetting each time sash 406 is closed.

The embodiments above are intended to be illustrative and not limiting. Additional embodiments are encompassed within the scope of the claims. Although the present invention has been described with reference to particular embodiments, those skilled in the art will recognize that changes may be made in form and detail without departing from the spirit and scope of the invention. For purposes of interpreting the claims for the present invention, it is expressly intended that the provisions of Section 112, sixth paragraph of 35 U.S.C. are not to be invoked unless the specific terms "means for" or "step for" are recited in a claim.

The invention claimed is:

1. A device to limit an opening of a window having a sash hingedly coupled to a window frame; comprising:

a sash bracket adapted to attach to the sash;

a limiting arm operably coupled to the sash bracket, the limiting arm presenting a first end and a second end, the first end of the limiting arm pivotally coupled to the sash bracket, the limiting arm further including a track engagement structure proximate the second end; and a track assembly adapted to attach to the window frame, the track assembly including a track and a release assembly, the track presenting a first end and an opposing second end and having a first opening which allows the track engagement structure proximate the first end of the track to enter the track and a second opening which allows the track engagement structure proximate the second end of the track to exit from the track, the track engagement structure of the limiting arm being slidable in the track, the release assembly disposed proximate the second end of the track and selectively operable to release the track engagement structure from engagement with the track, and wherein a biasing structure is operably coupled to the sash bracket and the limiting arm, the biasing structure biasing the limiting arm toward an engagement position in which the second end of the limiting arm is spaced apart from the sash.

2. The device of claim 1, wherein the release assembly includes at least two separately movable elements.

3. The device of claim 2, wherein the two separately movable elements include a slide and a pivot stop.

4. The device of claim 3, wherein the slide is arranged to slide longitudinally along the track.

5. The device of claim 4, wherein the track defines a second opening proximate the second end of the track which allows the track engagement structure to exit from the track, the slide being slidable between a first position in which the release assembly blocks the second opening of the track and a second position in which the second opening in the track is unblocked to enable the track engagement structure to exit from the track.

6. The device of claim 5, wherein the release assembly is operable to release the track engagement structure from the track by first, sliding the slide from the first position to the second position, and second, pivoting the pivot stop to unblock the second opening in the track.

7. The device of claim 6, further comprising a biasing structure operably coupled to the slide and the track, the biasing structure arranged to bias the slide toward the first position.

8. The device of claim 1, further comprising the biasing structure operably coupled to the sash bracket and the limiting arm, the biasing structure rotationally biasing the limiting arm about a pivot coupling the limiting arm to the sash bracket.

9. The device of claim 8, wherein when the sash is in an open position, the biasing structure positions the limiting arm such that the track engagement structure is registered with the opening which allows the track engagement structure to enter the track, so that as the sash is shifted from the open position toward the closed position, the track engagement structure engages in the track without operator intervention.

10. A window assembly, comprising:

a window frame;

a sash receivable in the window frame, the sash selectively shiftable through a first travel distance between a closed position in which the sash is received in the window frame and a fully open position in which the sash is hinged away from the window frame; and a sash opening limit device comprising:

a sash bracket attached to the sash;

a limiting arm operably coupled to the sash bracket, the limiting arm presenting a proximal end and a distal end, the proximal end of the limiting arm pivotally coupled to the sash bracket, the limiting arm further including a track engagement structure proximate the distal end; and a track assembly adapted to attach to the window frame, the track assembly including a track and a release assembly, the track presenting a first end and an opposing second end and having a first opening which allows the track engagement structure proximate the first end to enter the track and a second opening which allows the track engagement structure to exit from the track proximate the second end, the track engagement structure of the limiting arm being slidable in the track, the release assembly disposed proximate the second end of the track and selectively operable to release the track engagement structure from engagement with the track through the second opening in the track, wherein the track engagement structure is engaged in the track when the sash is in the closed position, and as the sash is shifted toward the open position, the track engagement structure slides in the track toward the release assembly, the release assembly preventing the track engagement structure from disengaging from the track until the release assembly is operated, the limiting arm acting to limit further movement of the sash to a second travel distance less than the first travel distance until the track engagement structure is disengaged from the track, and wherein a biasing structure is operably coupled to the sash bracket and the limiting arm, the biasing structure biasing the limiting arm toward an engagement position in which the distal end of the limiting arm is spaced apart from the sash.

11. The window assembly of claim 10, wherein when the sash is in the fully open position, the biasing structure positions the limiting arm such that the track engagement structure is registered with the opening which allows the track engagement structure to enter the track, so that as the sash is shifted from the fully open position toward the closed position, the track engagement structure engages in the track without operator intervention.

12. The window assembly of claim 10, wherein the release assembly includes at least two separately movable elements.

13. The window assembly of claim 12, wherein the two separately movable elements include a slide and a pivot stop.

14. The window assembly of claim 13, wherein the slide is arranged to slide longitudinally along the track, the slide is selectively shiftable between a first position in which the release assembly blocks the second opening in the track to prevent the track engagement structure from disengaging from the track and a second position in which the second opening is unblocked to enable the track engagement structure to exit from the track through the second opening.

15. The window assembly of claim 14, wherein the release assembly is operable to release the track engagement structure from the track by first, sliding the slide from the first position to the second position, and second, pivoting the pivot stop to unblock the second opening in the track.

16. The window assembly of claim 14, further comprising a second biasing structure operably coupled to the slide and the track, the second biasing structure arranged to bias the slide toward the first position.

* * * * *

UNITED STATES PATENT AND TRADEMARK OFFICE

CERTIFICATE OF CORRECTION

PATENT NO. : 8,505,240 B2
APPLICATION NO. : 12/938875
DATED : August 13, 2013
INVENTOR(S) : Nghi Christopher Nguyen et al.

It is certified that error appears in the above-identified patent and that said Letters Patent is hereby corrected as shown below:

In the Specification

Column 5, line 4:
"biased toward the window frame and so that he distal pins are" should be
-- biased toward the window frame and so that the distal pins are --

Column 6, line 45:
Delete "device" and insert -- device: --

Column 10, line 53:
"first arm 306 and second arm 308 can be move closer together" should be
-- first arm 306 and second arm 308 can be moved closer together --

Column 13, lines 27-28:
"action, device will return to the function of limiting opening" should be
-- action, the device will return to the function of limiting opening --

Column 13, line 42:
"When it is desire to open the window farther, an individual" should be
-- When it is desired to open the window farther, an individual --

Signed and Sealed this
Twenty-second Day of April, 2014

Michelle K. Lee

Michelle K. Lee
*Deputy Director of the United States Patent and Trademark Office*